US005739804A

United States Patent [19]

Okumura et al.

[11] Patent Number: 5,739,804

[45] Date of Patent: Apr. 14, 1998

[54] DISPLAY DEVICE

[75] Inventors: Haruhiko Okumura, Kawasaki; Go Ito, Tokyo, both of Japan

[73] Assignee: Kabushiki Kaisha Toshiba, Kawasaki, Japan

[21] Appl. No.: 401,265

[22] Filed: Mar. 9, 1995

[30] Foreign Application Priority Data

Mar. 16, 1994 [JP] Japan ..... 6-071566

[51] Int. Cl.[6] ..... G09G 3/36

[52] U.S. Cl. ..... 345/99; 345/100; 345/104; 345/182; 345/183; 348/793; 348/792

[58] Field of Search ..... 345/99, 100, 94, 345/104, 179, 182, 183; 348/792, 793, 634, 635, 637

[56] References Cited

U.S. PATENT DOCUMENTS 3,984,633 10/1976 Rutt et al. ..... 178/69.5

FOREIGN PATENT DOCUMENTS 540294A 5/1993 European Pat. Off. ..... 345/99

3-271795 3/1991 Japan .

3-51887 3/1991 Japan .

4043557 12/1992 Japan ..... 345/100

*Primary Examiner*—Glenton B. Burgess

*Attorney, Agent, or Firm*—Oblon, Spivak, McClelland, Maier & Neustadt, P.C.

[57] ABSTRACT

A liquid crystal display device having pixel selection switching elements in a one-to-one correspondence with pixels includes an interlace processing circuit for performing n (n is an odd number of 3 or larger): m (m is an arbitrary number equal to or smaller than n) interlace processing for a one-frame image signal, an n-fold rate converting device for performing n-fold rate conversion for the interlaced image signal, an image display for displaying an image by driving the pixel selection switching elements in accordance with the image signal subjected to the n-fold rate conversion, and a non-picture period processing means for disconnecting the n-fold rate converting device from the image display and performing desired processing for the image display during a non-picture period longer than a vertical blanking period.

13 Claims, 22 Drawing Sheets

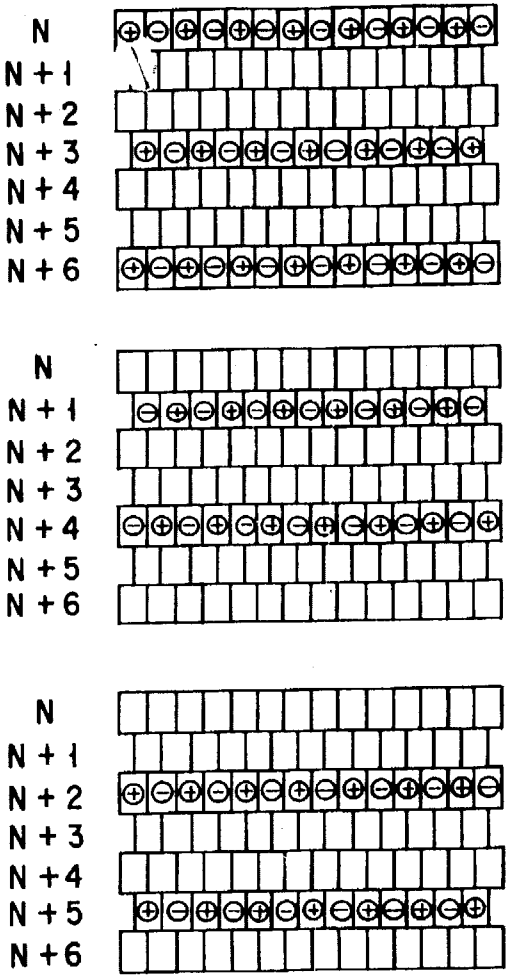
m1 FIELD
FIG. 1A PRIOR ART
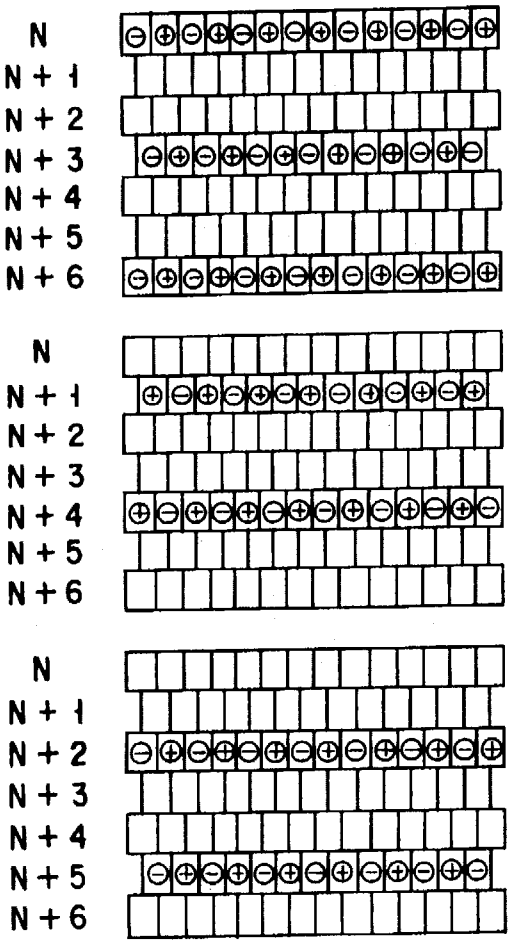
m2 FIELD
FIG. 1B PRIOR ART
m3 FIELD
FIG. 1C PRIOR ART
m4 FIELD
FIG. 1D PRIOR ART
m5 FIELD
FIG. 1E PRIOR ART
m6 FIELD
FIG. 1F PRIOR ART
⊕: POSITIVE POLARITY ⊖:NEGATIVE POLARITY ONE-FIELD
1/3 FIELD PERIOD (DISPLAY DRIVING PERIOD)
2/3 FIELD PERIOD (DETECTION PERIOD)
SUSTAIN PULSE
WRITE PULSE
PEN INPUT DETECTION PULSE
SCAN PULSE
CONSTANT
SIGNAL S2 PORTION (DISPLAY SIGNAL DRIVING PERIOD)
SIGNAL S3 PORTION (PEN INPUT DETECTION PERIOD)
SAME AS ABOVE
CATHODE DIRECTION
ANODE DIRECTION
ANODE 1
CATHODES
C1
C2
C3
C4
C5
ANODE A2
ANODE A3
DETECTION OUTPUT

DISPLAY DEVICE

BACKGROUND OF THE INVENTION

1. Field of the Invention

The present invention relates to a liquid crystal display device in which a period other than an image display period is extended.

2. Description of the Related Art (1) Liquid crystal display devices are thin and capable of being driven with low voltages. Therefore, liquid crystal display devices are beginning to be used as displays of wordprocessors and personal computers as well as display devices of wrist watches and pocket calculators. In addition, to allow users to perform easy operations, some information apparatuses have a pen input function by which data is input by designating a specific position on a liquid crystal display with a pen.

In the pen input function by which a designated position is located by detecting a physical quantity such as a change in the capacitance of a display pixel, processing such as detection of a position designated by a pen on a liquid crystal display must be executed in a short blanking period except for a picture period. For this reason, it is necessary to execute the pen input processing at a high speed, and this results in a large consumption power. Also, since the processing time is short, it is impossible to perform the processing with a satisfactory performance in respect of position detection accuracy and operability.

(2) On the other hand, in recent years the resolution (the number of pixels) of liquid crystal displays has been increased, and this has increased the driving frequency. Under these circumstances, power supply level shift driving (e.g., low-voltage driving such as the method disclosed in Lecture Manuscripts for the 1993 Television Society Annual Meeting, pp. 37–38, 1993) have been proposed for the purpose of allowing a driving IC to operate at a low voltage to be able to process high-speed signals. In this driving method, the power-supply voltage is shifted in synchronism with the polarity of an image. A powerful driving circuit is required to drive a large power-supply capacitor. In addition, this method is difficult to apply to driving, such as dot inversion, in which the power supply must be driven at a high speed. Therefore, an application of the method is presently restricted to signal line inversion driving. The signal line inversion driving has the characteristic that a horizontal crosstalk which is generated by an increase in the resistance of a common electrode when the size of a screen is increased is not easily generated. However, a vertical crosstalk caused by a leak from a TFT readily occurs. As a result, the specifications required of the TFT characteristics become strict.

As a method for solving these problems, a method (e.g., the method disclosed in Jpn. Pat. Appln. KOKAI Publication No. 3-51887) has been proposed in which the power supply is held constant and a switch is provided in a driving IC to perform switching between signal lines for each field. Unfortunately, even by the use of this method the consumption power increases in realizing the dot inversion driving by which a high image quality is achieved by the combination of signal line inversion and line inversion, since it is necessary to invert the polarity for each line.

Consider factors which determine the consumption power of driving circuits (module circuits). In the following description, it is assumed that the consumption power does not include consumption power caused by a bias current which flows in a DC manner.

The driving circuits are basically classified into a signal line driver, a buffer circuit, a control signal generator, a common driver, and a gate line driver. Each of these circuits will be described in detail below.

i) Signal line driver

A signal line driver is a driving IC for driving signal lines and is of either a digital or analog type. Since OA images are digital images, the consumption power of a digital type driving IC having a good matching property will be described.

A digital driving IC basically consists of a shift register for determining the signal sampling time, a latch circuit for latching digital signals, a D/A converter for converting digital signals into analog signals, and an output buffer for driving signal lines. Since factors which determine the consumption power are the latch circuit and the output buffer, only these two components will be described below.

Assuming the input equivalent capacitance pertinent to an image signal is $C_1$, the input equivalent capacitance pertaining to a sampling clock is $C_{ck}$, the image sampling frequency is $f_s$, and the latch circuit power-supply voltage is $V_1$, a maximum consumption power $P_1$ of the latch circuit is given as follows:

$$P_1=(C_1+2C_{ck})*f_s/2*V_1^2 \quad (1)$$

Assuming that the signal line capacitance is $C_s$, the horizontal driving frequency is $f_h$, the number of horizontal pixels is $N_h$, and the signal line voltage is $V_s$, a maximum consumption power $P_{ob}$ of the output buffer is represented by the following equation:

$$P_{ob}=N_h*C_s*f_h*V_{s2}/2 \quad (2)$$

ii) Buffer circuit

A buffer circuit is a component which receives an input digital signal, performs noise removal and waveform shaping for the received signal, and supplies a resulting stable signal to the signal line driver. Although the buffer circuit is omitted in some cases, the circuit is herein taken into consideration since it is basically necessary. Assuming that the input equivalent capacitance of the circuit with respect to the clock $f_s$ is $C_{bc}$, the input equivalent capacitance of the circuit with respect to an image signal is $C_{bp}$, and the power-supply voltage of the buffer circuit is $V_b$, a maximum consumption power $P_b$ of the buffer circuit is expressed as follows:

$$P_b=(2C_{bc}+C_{bp})*f_s/2*V_b^2 \quad (3)$$

iii) Control signal generator

A control signal generator is basically provided in the form of a gate array, and so the internal frequency changes in accordance with the signal. However, the consumption power relating to the image sampling clock $f_s$ is considered to be of importance. Assuming the equivalent internal capacitance of the circuit with respect to the clock $f_s$ is $C_{gac}$, the input equivalent capacitance of the circuit with respect to an image signal is $C_{gap}$, and the power-supply voltage of the gate array is $V_{ga}$, a maximum consumption power $P_{ga}$ of the entire gate array is given by the following equation:

$$P_{ga}=(2C_{gac}+C_{gap})*f_s/2*V_{ga}^2 \quad (4)$$

iv) Common driver

A common driver is for driving a common capacitance $C_c$. Assuming that the driving frequency of the common capacitance is $f_c$ and the power-supply voltage of the common driver is $V_c$, a maximum consumption power $P_c$ of the common driver is as given below. Note that $f_c$ is one-half of the horizontal driving frequency $f_h$ in the case of common inversion.

$$P_c = C_c * f_c * V_c^2 \tag{5}$$

v) Gate line driver

A gate line driver is for driving a capacitance $C_g$ of each gate line. Assuming that the driving frequency of gate lines is $f_g$ and the power-supply voltage of the gate line driver is $V_g$, a maximum consumption power $P_g$ of the gate line driver is as given below. Note that the driving frequency $f_g$ of gate lines is normally equal to the horizontal driving frequency $f_h$.

$$P_g = C_g * f_h * V_g^2 \tag{6}$$

vi) Consumption power $P_{all}$ of entire circuit

From the foregoing, a consumption power $P_{all}$ of the entire circuit is given by $$\begin{aligned} P_{all} &= P_1 + P_{ob} + P_b + P_{ga} + P_c + P_g \\ &= (C_1 + 2C_{ck}) * f_s/2 * v_1^2 + N_h * C_s * f_h * \\ &\quad v_s^2/2 + (2C_{bc} + C_{bp}) * f_s/2 * v_b^2 + \\ &\quad (2C_{gac} + C_{gap}) * f_s/2 * v_{ga}^2 + C_c * f_c * v_c^2 + \\ &\quad c_g * f_h * v_g^2 \end{aligned}$$

Assuming that the common electrode is at a constant voltage and $N_h * C_s >> C_g$, $$\begin{aligned} P_{all} &= (C_1 + 2C_{ck} + 2C_{bc} + C_{bp} + 2C_{gac} + C_{gap}) * \\ &\quad (f_s/2) * v^2 + N_h * C_s * (f_h/2) * v^2 \\ &= P_{all}(C, f, V) \end{aligned} \tag{7}$$

That is, the consumption power is a function of the capacitance C, the driving frequency f (the horizontal frequency and the clock frequency of an image), and the power-supply voltage v of the digital system.

The capacitance C is determined by the device structure, and the voltage V is determined by the process and the structures of an IC and a liquid crystal panel, e.g., the V-T characteristic of a liquid crystal. However, the frequency f is determined by the system and the image quality, e.g., the horizontal frequency of an image and the flicker characteristic. Therefore, the frequency f can be decreased by selecting a power driving method. When the driving frequency is decreased, however, the pixel potential normally decreases since the holding time increases for the same off-leakage current of a TFT. For this reason, the flicker component increases, and the frequency of the flicker component decreases. Consequently, the flicker becomes conspicuous, leading to a large deterioration in the image quality.

As a method for preventing this, Japanese Patent Application No. 2-69706, for example, has disclosed a multifield driving method (to be referred to as an MF driving method hereinafter) in which the driving frequency is lowered by dividing one field image into an odd number of subfields. FIGS. 1A to 1F are schematic views showing this MF driving method.

First, a method of driving when the mth frame is to be displayed will be described. As illustrated in FIG. 1A, in the first Tf/3 period the first, fourth, . . . , Nth, (N+3)th, (N+6)th, . . . gate lines are driven. At the same time, signal line inversion driving is performed such that an image signal of positive polarity is applied to odd-numbered signal lines and an image signal of negative polarity is applied to even-numbered signal lines. In the next Tf/3 period, as shown in FIG. 1B, the second, fifth, . . . , (N+1)th, (N+4)th, (N+7)th . . . lines are driven. In the next Tf/3 period, the third, sixth, . . . , (N+2)th, (N+5)th, (N+8)th, . . . lines are driven as in FIG. 1C. In the next Tf/3period, as illustrated in FIG. 1D, the lines to be driven are the first, fourth, Nth, (N+3)th, (N+6)th, . . . lines as before, but the polarity is opposite to that in FIG. 1A. This realizes AC driving of a liquid crystal. The driving operations shown in FIGS. 1E and 1F are opposite-polarity driving operations of FIGS. 1B and 1C, respectively, so descriptions thereof will be omitted.

Flicker components in the above drivings will be analyzed below.

Possible causes of flicker are ON current deficiency, a punch-through voltage of a TFT, and an OFF current of a TFT. The ON current deficiency or the TFT punch-through voltage can be compensated for by an array structure or by punch-through correction driving. The OFF current of a TFT, however, is considered to have a larger effect than usual on the flicker characteristic unless the OFF characteristics of a TFT including a light leak are perfect, since in principle the MF driving prolongs the holding time of a TFT to be longer than that in normal driving.

The cause of the TFT OFF current, therefore, will be primarily analyzed below.

To begin with, the potential variation waveform of a pixel is approximated as in FIG. 2A. That is, it is assumed that a variation of $V_p$ takes place in driving with the positive polarity because holding is good, whereas a potential change of $V_N$ ($>V_p$) occurs within one field in driving with the negative polarity because of poor holding. At this time a potential i (t) is as follows:

$$i(t) = v_S + v_N - \frac{2v_{NT}}{\pi} \quad (0 \leqq t < \pi) \tag{8}$$

$$v_S + v_P - \frac{2v_{Pt}}{\pi} \quad (-\pi \leqq t < 0)$$

To obtain an actual transmittance change, it is necessary to multiply the response characteristic of a liquid crystal by the above variation on the frequency axis. However, since the response characteristic is a complicated characteristic which depends upon the potential level, the potential variation of a pixel will be exclusively analyzed as a luminance change.

A Fourier expansion of this potential variation yields the following equation:

$$\begin{aligned} i(t) = \; & v_S + \frac{1}{\pi} \sum_{k=1}^{\infty} \frac{2}{k^2\pi} (1 - (-1)^k) \times \\ & (v_N - v_P)\sin kt + \frac{1}{K} (1 + (-1)^k) \times \\ & (v_N + v_P)\cos kt \end{aligned} \tag{9}$$

when only the fundamental wave component (30 Hz) which is important as a flicker is taken into account, the following equation is obtained for k=1:

$$F_{30} = \frac{4}{\pi^2} (v_N - v_P) \tag{10}$$

This means that each pixel has a spectrum $F_{30}$, FIG. 2B, as a flicker component. As a method of removing this flicker component, the following two methods are possible.

Method 1) Increase the frequency of the luminance change i (t) itself.

Method 2) Compensate for the flicker component by using adjacent pixels.

Normally, method 1 is not used so often since the speed of an image signal is raised. In the line inversion (common inversion) or the signal line inversion, compensation is accomplished using two pixels in accordance with method 2. Therefore, the latter method 2 will be described in detail below.

In either method an opposite-polarity signal is applied to adjacent pixels. Therefore, an average luminance $i_a(t)$ of the two pixels is represented by the following equation:

$$i_a(t) = i(t) + i\left(t - \frac{\pi}{\omega 0}\right) \tag{11}$$

$$\omega_0 = \pi/T_f$$

By performing a Fourier transformation, $$I_a(\omega) = I(\omega)(1 - \exp(j\omega\pi/\omega_o)) \tag{12}$$

Consequently, $I_a(\omega_0) = 0$; that is, the flicker component is completely removed.

In the above compensation, the compensating pixels are two pixels. In the MF driving in which the compensating pixels are N pixels, the average luminance $i_a(t)$ and the Fourier transform $I_a(\omega)$ of these N neighboring pixels are as follows:

$$i_a(t) = \sum_{n=0}^{N-1} i\left(t + \frac{n}{N} \times \frac{2\pi}{\omega_0}\right) \tag{13}$$

$$I_a(\omega) = \sum_{n=0}^{N-1} I(\omega)\exp\left(j\frac{n}{N}\ 2\omega\pi/\omega_0\right) \tag{14}$$

Compensation for the flicker component using three pixels will be described below. In FIGS. 3A and 3B, the transmittance changes $\underline{i}(t)$ of three pixels, calculated from Equation (8), are indicated by the solid line, the alternate long and short dashed line, and the dotted line, and the transmittance change as a whole is represented by $i_a(t)$. FIG. 4 shows the frequency spectra of flicker components. As is apparent from FIG. 4, if the transmittance changes $\underline{i}(t)$ of the pixels to be compensated for each other are equal, the flicker component which is originally 2Tf (Tf: field period=1/60 sec) can be reduced to 2Tf/3, i.e., 1/90 sec which is a 1/3 period, by the three-pixel compensation. Consequently, the flicker component no longer stands out as a flicker. That is, as is evident from Equation (13), the phases of the frequency spectra of these pixels are shifted 120° from one another. Therefore, the pixel components add up in a vector manner to cancel each other out. By using this principle, compensation using the third, fifth, seventh, . . . , (2N+1)th, . . . pixels, i.e., odd-numbered pixels is equally possible. Since the driving frequency can be decreased as the number of pixels to be compensated is increased, the consumption power can be reduced.

Generally, using Equation (7) which determines the consumption power, the consumption power $P_{MF}$ in the MF driving is given by the following equation:

$$\begin{aligned} P_{MF} &= (C_1 + 2C_{ck} + 2C_{bc} + C_{bp} + 2C_{gac} + C_{gcp}) \times \\ &\quad \{f_s/2(2N+1)\} * v^2 + \\ &\quad N_h * C_s * \{f_h/2(2N=1)\} * v^2 \\ &= P_{all}/(2N+1) \end{aligned} \tag{15}$$

As can be seen from the above equation, the consumption power which depends upon the driving frequency of a module circuit can be decreased to 1/(2N+1). This makes it possible to largely decrease the consumption power.

On the basis of the analytical results of the MF driving, the present inventors conducted an experiment on the flicker reducing effect by using actual panels. Since the experiment was done as a basic experiment, N=1, i.e., the number of subfields was set to 3. In this condition, a gray level with a transmittance of 50% was displayed under the conditions of 1) Normal driving (60 Hz)

2) Driving frequency was simply decreased (20 Hz)

3) MF driving (N=1), and a change in the transmittance with time was detected with a photodetector. The change with time thus detected was converted into a frequency component by an FFT analyzer. Thereafter, the amounts of 20, 40, and 60 Hz components, as fundamental waves, were analyzed and evaluated.

In each of the normal driving, the 20 Hz driving, and the MF driving (N=1), the relative level of the flicker component with respect to the average luminance was measured. The measurement results are summarized in Table 1. Table 1 reveals the following.

1) When the driving frequency was decreased to 20 Hz, components of 20, 40, 60, 80 Hz, . . . were produced as flicker components as expected.

2) The 20-Hz component disappeared by the MF driving as expected; this frequency component was tripled, i.e., converted into a 60-Hz component.

3) The 60-Hz component in the MF driving was on the same level as in the normal driving. That is, deterioration in the image quality caused by a flicker in the MF driving was almost equal to that in the normal driving.

TABLE 1

| Driving method | Frequency component of flicker in each driving method: Frequency component of flicker (dB) 20 Hz | 40 Hz | 60 Hz | 80 Hz | |
|---|---|---|---|---|---|
| MF driving | 53 | | 41 | | |
| Signal line inversion | 51 | | 39 | | |
| 20 Hz driving | 26 | 34 | 41 | 45 | ← corresponding to flicker for each pixel |

As discussed above, the MF driving method is very effective for a frame flicker. However, as shown in Table 1, in this driving method the holding time is largely increased to increase the flicker component of each pixel (normally each line). Consequently, horizontal stripes are produced in each field, leading to deterioration in the image quality of still images.

In addition, it turns out by an experiment that in high-definition still images having no correlation between the images, individual flicker components are no longer compensated for, and, of these flicker components, new carriers are generated on the special frequency axis by the difference between the positive and negative polarities, resulting in an aliasing distortion. Since this aliasing distortion is not at rest but moves, it stands out considerably. The result is a large deterioration in the image quality.

As has been discussed above, conventional liquid crystal display devices have problems such as a large consumption power and deterioration in the image quality caused by a horizontal crosstalk or a vertical crosstalk. In addition, in the MF driving capable of reducing the consumption power, a long holding time increases a line flicker to cause line interference in still images. Also, in images containing a large amount of high-frequency components, this high-frequency components change into an aliasing distortion by carriers produced by the difference in holding characteristic between the positive and negative polarities, resulting in a large deterioration of the image quality. Furthermore, a blanking period (retrace period) during which no images are displayed is commonly used as the period for correcting this deterioration. Unfortunately, since this period is as short as about 10% of the picture period, the effect of correction is unsatisfactory.

SUMMARY OF THE INVENTION

As described above, to perform desired processing making use of display pixels or driving circuits, such as pen input or correction for improving the image quality, it is necessary to use a blanking period (retrace period) during which no images are displayed or to shorten the pixel display period. Also, there are other problems such as an increase in the driving frequency, an increase in the consumption power, and an inability to perform processing with satisfactory contents.

The present invention has been made in consideration of the above problems and has as its object to provide a display device capable of extending a period other than the actual picture period to be longer than the retrace period and performing desired processing in this period.

The first display device of the present invention is a display device having pixel selection switching elements in a one-to-one correspondence with pixels, comprising interlace processing means for performing n (n is an odd number of 3 or larger): m (m is an arbitrary number equal to or smaller than n) interlace processing for a one-frame image signal, n-fold rate converting means for performing n-fold rate conversion for the interlaced image signal, image display means for displaying an image by driving the pixel selection switching elements in accordance with the image signal subjected to the n-fold rate conversion, and non-picture period processing means for disconnecting the n-fold rate converting means from the image display means and performing desired processing for the image display means during a period after the one-frame image signal is displayed and before the next image signal is displayed.

The second display device of the present invention is a display device having pixel selection switching elements in a one-to-one correspondence with pixels, comprising interlace processing means for performing n (n is an odd number of 3 or larger): m (m is an arbitrary number equal to or smaller than n) interlace processing for a one-frame image signal, image display means for displaying an image by driving the pixel selection switching elements in accordance with the interlaced image signal, and non-picture period processing means for disconnecting the interlace processing means from the image display means and performing desired processing for the image display means during a period after an image signal corresponding to one pixel is displayed and before an image signal corresponding to the next pixel is displayed.

As the desired processing, it is preferable to perform processing for applying a correction signal to each pixel to improve image quality, or pen input processing for detecting a position on a liquid crystal panel designated by an operator with an input pen.

The third display device of the present invention is a display device having a plurality of address lines along a horizontal scan direction, a plurality of signal lines along a vertical direction, pixels at intersections between the address lines and the signal lines, and pixel selection switching elements provided in a one-to-one correspondence with pixels, comprising scan control means for performing control such that at least one address line does not drive the pixel selection switching elements while the address lines are driven from the first to the last pixel rows, and non-picture period processing means for reading out the signal lines in a period during which the switching elements are not driven.

Preferably, the means for performing processing in a period except for a picture period can also be so designed as to read out, from the signal lines, a change in a physical quantity produced when an operator designates a position on a liquid crystal panel with an input pen.

In the liquid crystal display device according to the first display device of the present invention, the interlace processing means performs n (n is an odd number of 3 or larger): m (m is an arbitrary number equal to or smaller than n) interlace processing for a one-frame image signal. Thereafter, the n-fold rate converting means performs n-fold rate conversion for the interlaced image signal. Consequently, the period required to display the image signal is shortened. Therefore, a period other than the picture period, which is after an image signal of one frame is displayed and before an image signal of the next frame is displayed, is extended to be very long compared to that in conventional systems.

The means for performing processing in a period except for the picture period uses this extended, free-to-use period other than the picture period. That is, during this period the means can disconnect the n-fold rate converting means from the image display means and perform desired processing for the image display means.

In the liquid crystal display device according to the second display device of the present invention, the interlace processing means performs n (n is an odd number of 3 or larger): m (m is an arbitrary number equal to or smaller than n) interlace processing for a one-frame image signal. Consequently, the period required to display the image signal is shortened. Therefore, a period other than the picture period, which is after an image signal of one frame is displayed and before an image signal of the next frame is displayed, is extended to be very long compared to that in conventional systems.

The means for performing processing in a period except for the picture period uses this extended, free-to-use period other than the picture period. That is, during this period the means can disconnect the n-fold rate converting means from the image display means and perform desired processing for the image display means.

In the liquid crystal display device according to the third display device of the present invention, while the address lines are driven from the first to the last pixel rows, the scan control means performs control such that at least one address line does not drive the pixel selection switching elements. During this period, the means for performing processing in a period except for the picture period reads out a predetermined signal from the signal lines. This makes it possible to perform desired processing (e.g., detection of a change in a physical quantity, such as a capacitance, which is produced when an operator designates a position on a liquid crystal panel with an input pen) by using the extended period other than the picture period.

The processing performed in a period except for the picture period is not limited to correction of image deterioration or the pen input detection indicated in the third display device. That is, it is also possible by using this period to reduce the consumption power by turning off the power supply for supplying power to the circuits while the pixel selection switching elements are kept OFF.

The first, second, and third display devices of the present invention can be applied not only to TFT and TFD liquid crystal display devices as discussed above but also to general display devices having a memory property. Examples are a ferroelectric liquid crystal and an antiferroelectric liquid crystal having a memory property in the liquid crystal itself, a plasma display (PDP) which operates with a memory property, and a vacuum micro display device incorporating a memory element.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 1A to 1F are views of pixels of a display device for explaining the outline of a conventional driving method;

DETAILED DESCRIPTION OF THE PREFERRED EMBODIMENTS

Embodiments of the present invention will be described in detail below.

(1st Embodiment)

Figure 2A:
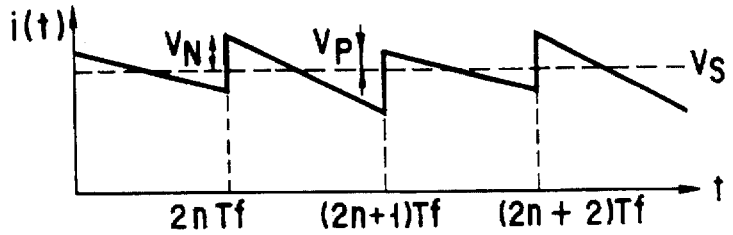
FIG. 2A PRIOR ART
FIGS. 2A and 2B are graphs showing the approximations of flicker waveforms in the conventional driving method.
Figure 2B:
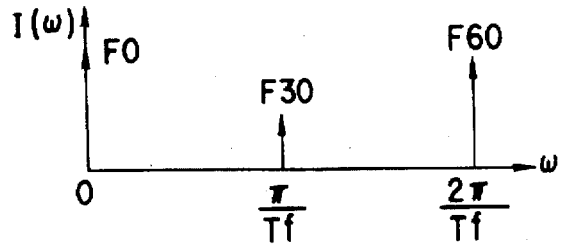
FIG. 2B PRIOR ART
Figure 3A:
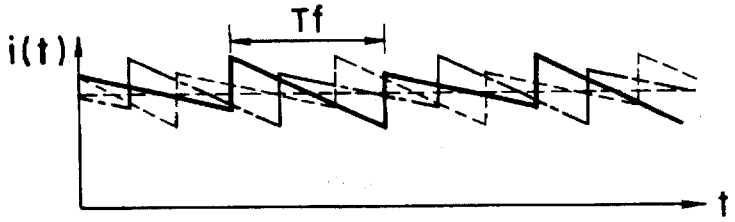
FIG. 3A PRIOR ART
FIGS. 3A and 3B are graphs for explaining a flicker compensating effect in the conventional driving method.
Figure 3B:
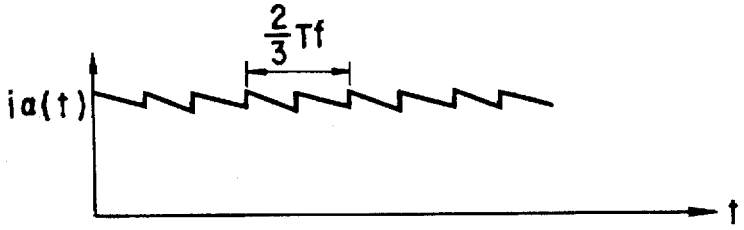
FIG. 3B PRIOR ART
Figure 4:
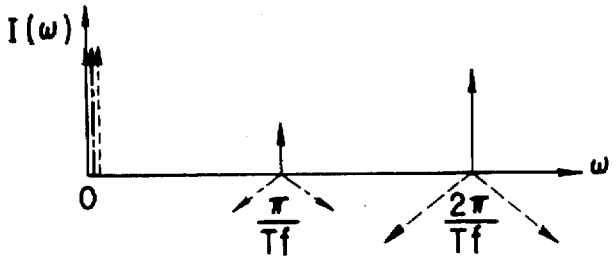
FIG. 4 PRIOR ART
FIG. 4 is a graph showing the spectra of flicker components in the conventional driving method.
Figure 5:
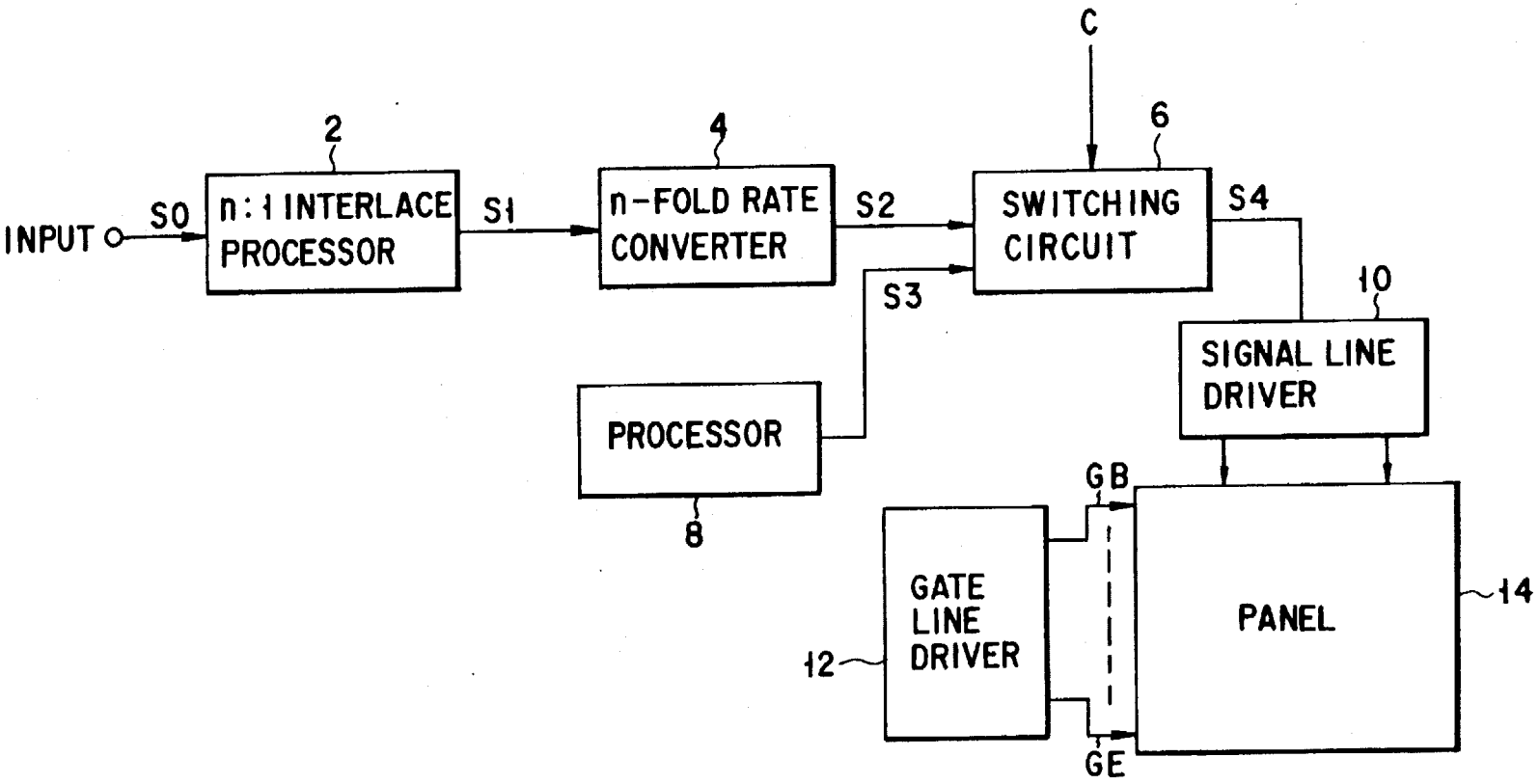
FIG. 5 is a block diagram showing the arrangement of the major components of the first embodiment of the present invention.

A liquid crystal display device according to the first embodiment of the present invention will be described below. FIG. 5 shows the arrangement of the major components of the liquid crystal display device of this embodiment. This liquid crystal display device includes an n:1 interlace processor 2, an n-fold rate converter 4, a switching circuit 6, a processor 8, a signal line driver 10, a gate line driver 12, and a liquid crystal display panel 14. The value of n is an arbitrary integer of 2 or larger. The arrangement of this embodiment will be described assuming n=3.

In addition, the liquid crystal display device of this embodiment makes use of a multifield driving method by which the driving frequency is decreased by dividing one field image into an odd number of subfields. Since this multifield driving method is well known to those skilled in the art, a detailed description thereof will be omitted.

Furthermore, the processing performed by the processor 8 can have any contents. In this embodiment, however, correction processing for improving deterioration in displayed images which is a problem in conventional techniques will be explained as an example.

In the above arrangement, a well-known circuit using the multifield driving method applies an image signal input S0 of one frame to the 3:1 interlace processor 2. Note that in FIG. 6, reference symbol P1 represents a signal portion corresponding to any of the first, fourth, . . . , (3 m−2)th, . . . gate lines; P2, a signal portion corresponding to any of the second, fifth, . . . , (3 m−1)th, . . . , gate lines; and P3, a signal portion corresponding to any of the third, sixth, . . . , 3 mth, . . . gate lines.

The 3:1 interlace processor 2 performs 3:1 interlace processing for each input image signal S0 corresponding to one field, obtaining a signal S1 whose driving frequency is decreased to ⅓. In this case, as in FIG. 6, a signal portion corresponding to P1 is extracted from the input image signal S0 corresponding to the first field; a signal corresponding to P2 is extracted from the input image signal S0 corresponding to the next field; and a signal portion corresponding to P3 is extracted from the input image signal S0 corresponding to the second next field. This processing is repeatedly executed.

Subsequently, the 3-fold rate converter 4 performs 3-fold rate conversion for the signal S1 to yield a signal S2. The 3-fold rate converter 4 can be constituted by using, e.g., a field memory. In this case a memory capacity which is ⅓ of the frame capacity is possible.

The resulting signal S2 is written in corresponding pixels of the liquid crystal panel 14 at a normal line frequency in a line sequential manner by using the switching circuit 6 which is controlled by a switching signal C and the signal line driver 10 and the gate line driver 12, each constituted by using a known technique.

Figures 6A, 6B, 6C:
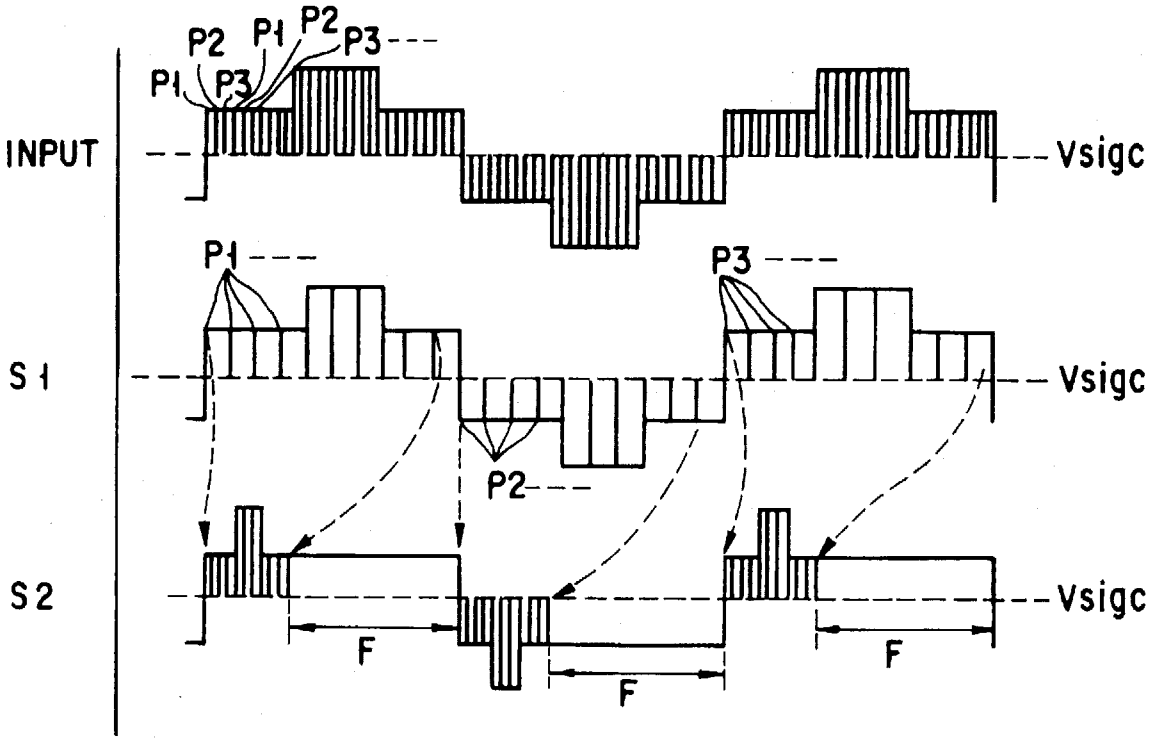
FIG. 6 is a view showing the driving signal voltages and the timing charts of the first embodiment of the present invention.
Figures 6D, 6E, 6F, 6G, 6H:
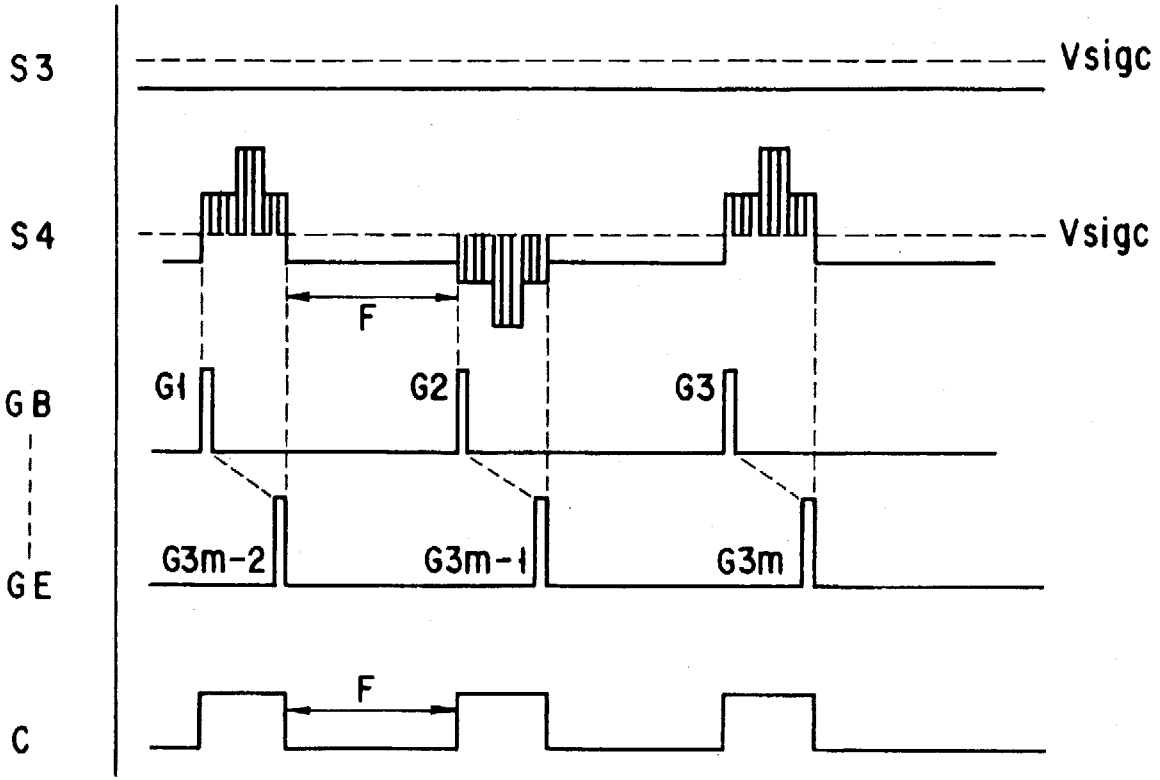

Consequently, a nonused period F, FIG. 6, during which no images are displayed, is produced after an image signal of one field is written in pixels and before an image signal of the next field is written.

As described above, in this embodiment a period other than the picture period can be extended to be extremely longer than the retrace period. This makes it possible to perform desired processing by using this period.

Correction processing performed using the period F will be described below. Assume that the processor 8 is a correction signal generator having a function of generating a correction signal.

In this correction processing, a negative signal S3 is applied to a pixel in order to make the holding characteristic of the positive polarity equal to that of the negative polarity. That is, a positive pixel has a good holding characteristic, so it makes no difference if the signal line voltage has negative polarity. However, since a negative pixel has a poor holding characteristic, it is desirable in respect of holding characteristic that a voltage of the same polarity be applied. The holding characteristics of the positive and negative polarities are made equal partly because the difference usually causes a flicker. In addition, in performing low-consumption-power driving (MF driving) as discussed earlier in "Description of the Related Art", if an image containing a large quantity of high-frequency components is displayed, carriers which give rise to an aliasing distortion are produced. A major cause of the production of the carriers is the difference between the holding characteristics of the polarities. That is, to suppress the aliasing distortion, eliminating the polarity dependence of the holding characteristic, rather than improving the holding characteristic itself, is most effective. For this reason, a constant voltage of negative polarity such as the signal S3, FIG. 6, is generated by using the processor 8, and a signal S4 is obtained by controlling the switching circuit 6 which receives the signals S2 and S3.

This negative level is preferably determined such that the amount of crosstalk is small with respect to an image signal of 10% level with which crosstalk readily occurs or to a 50%-level signal with which the transmittance changes sharply. Also, if the correction voltage has a fixed value as in this embodiment, an increase in the consumption power for writing image signals at a high speed can be reduced by using the correction portion. That is, it is only necessary to hold the correction voltage with the capacitance of a signal line by writing the voltage in the signal line or to write the correction voltage in a signal line by driving the signal line driver in a certain period larger than one horizontal frequency. This makes it possible to stop the operation (clock) of the signal processing system almost completely during the correction. Consequently, the average consumption power becomes equivalent to that in the 3:1 interlace, i.e., a low consumption power is achieved.

In addition, crosstalk is reduced as the period during which the voltage which causes crosstalk is applied on a signal line is shortened. That is, in the driving method of this embodiment the period in which an image signal is applied on a signal line is ⅓ that in conventional methods, and so the amount of crosstalk is also nearly ⅓. When crosstalk is reduced in this way, the pixel capacitance can also be decreased. In correspondence with this, a decrease in the aperture efficiency caused by the holding capacitance can be improved, resulting in an improvement in the aperture efficiency.

In this embodiment, an input image signal is interlaced at a ratio of 3:1. It is also possible to use a regular noninterlace signal, an N:1 interlace signal, or an N:M (M<N) interlace signal without departing from the gist of the present invention.

(2nd Embodiment)

Figure 7:
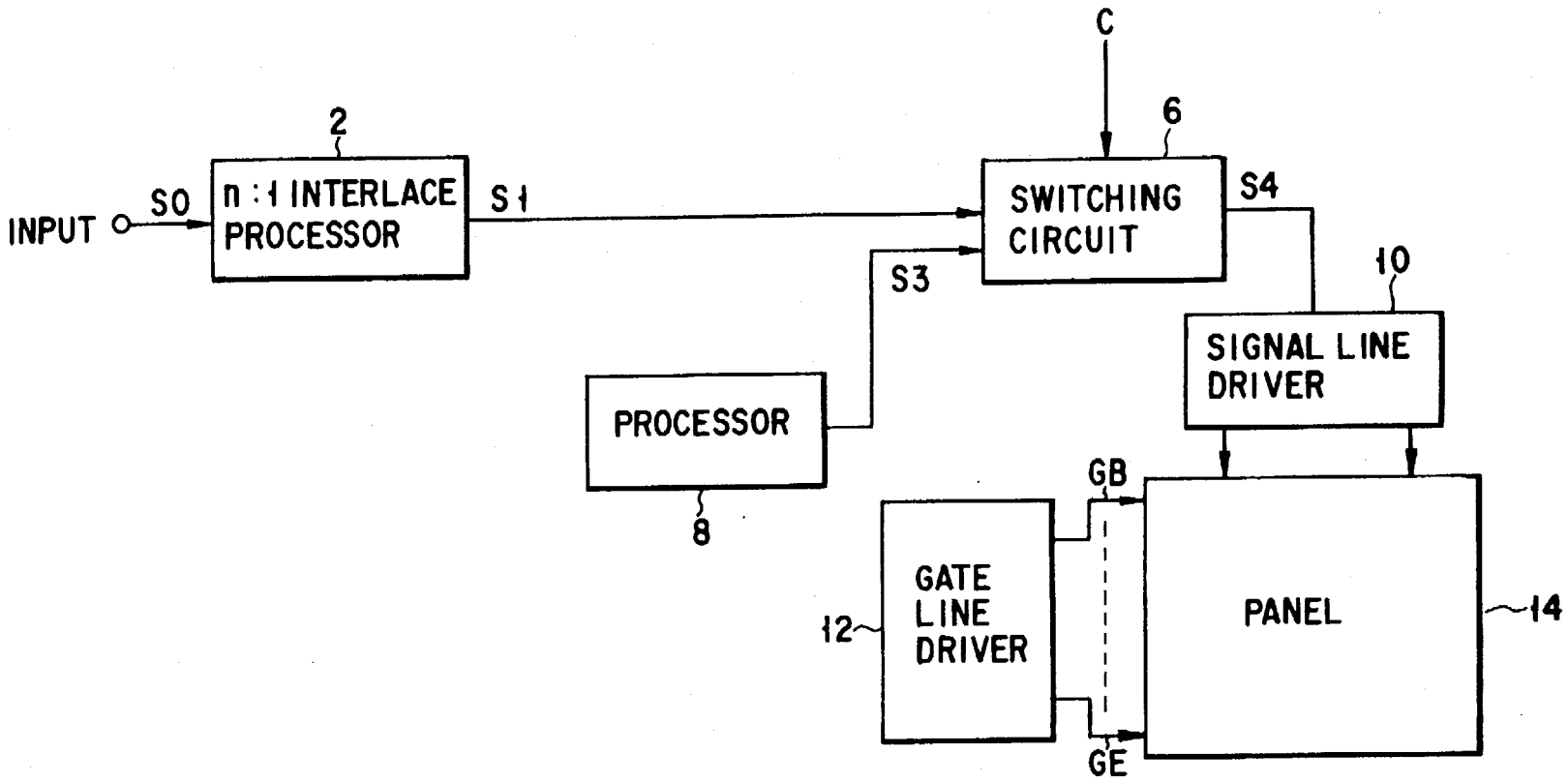
FIG. 7 is a block diagram showing the arrangement of the major components of the second embodiment of the present invention.

A liquid crystal display device according to the second embodiment of the present invention will be described below. As illustrated in FIG. 7, the liquid crystal display device of this embodiment has the same arrangement as the liquid crystal display device of the first embodiment illustrated in FIG. 5 except that the n-fold rate converter 4, FIG. 5, is absent and therefore an output from an n:1 interlace processor 2 is applied to a switching circuit 6 without passing through n-fold rate conversion. That is, the liquid crystal display device of this embodiment includes the n:1 interlace processor 2, the switching circuit 6, a processor 8, a signal line driver 10, a gate line driver 12, and a liquid crystal display panel 14. The value of n is an arbitrary integer of 2 or larger. The arrangement of this embodiment will be described assuming n=3.

In addition, the liquid crystal display device of this embodiment makes use of a multifield driving method by which the driving frequency is decreased by dividing one field image into an odd number of subfields. Since this multifield driving method is well known to those skilled in the art, a detailed description thereof will be omitted.

Furthermore, the processing performed by the processor 8 can have any contents.

Figures 8A, 8B, 8C:
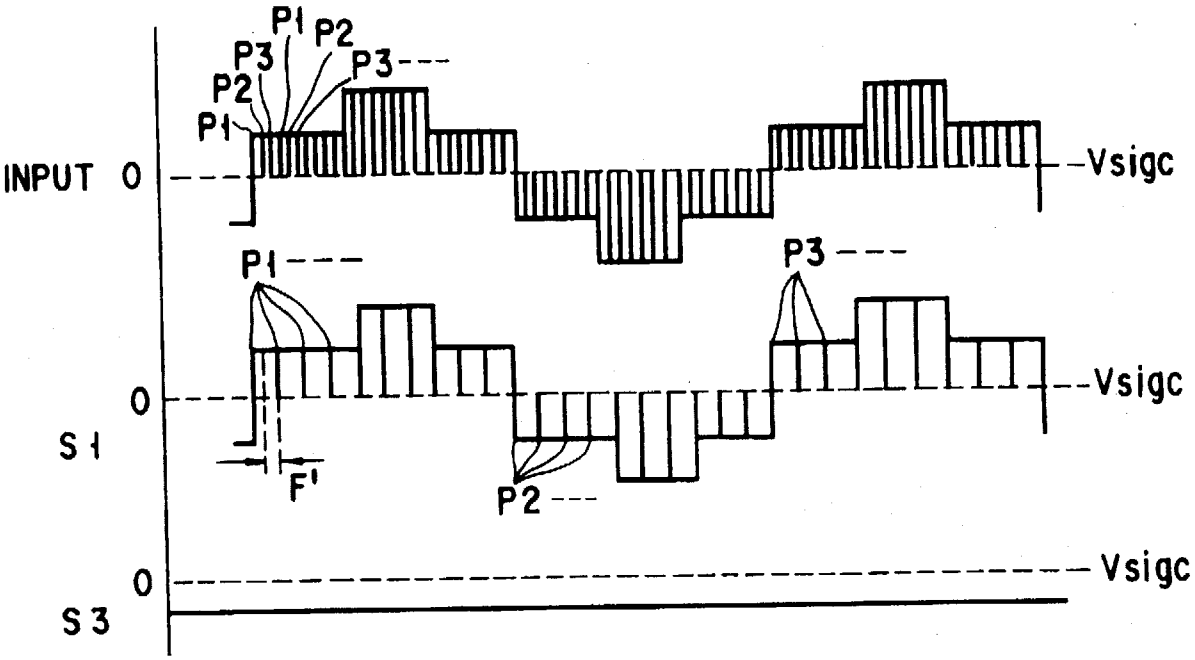
FIG. 8 is a view showing the driving signal voltages and the timing charts of the second embodiment of the present invention.
Figures 8D, 8E, 8F, 8G:
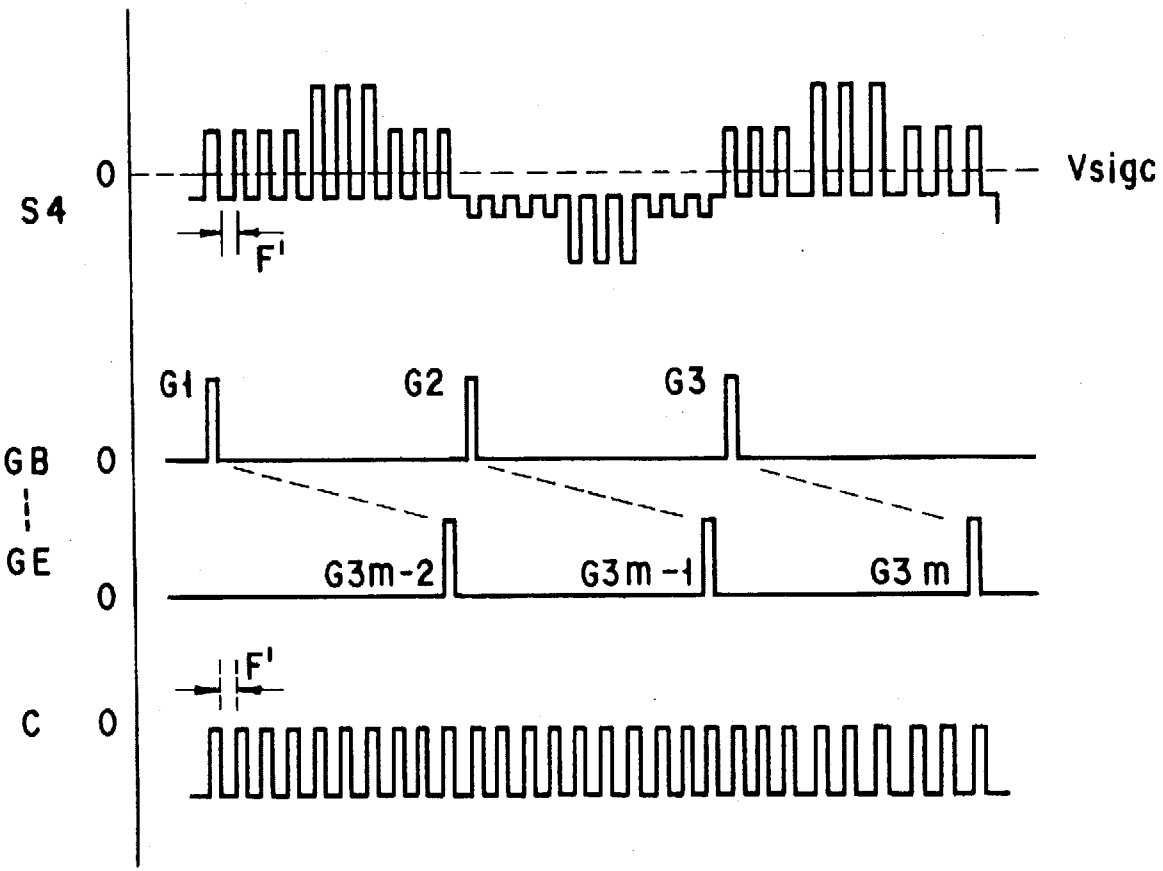

In the above arrangement, a well-known circuit using the multifield driving method applies an image signal input S0 of one frame to the 3:1 interlace processor 2. Note that in FIG. 8, reference symbol P1 represents a signal portion corresponding to any of the first, fourth, . . . , (3 m−2)th, . . . gate lines; P2, a signal portion corresponding to any of the second, fifth, . . . , (3 m−1)th, . . . gate lines; and P3, a signal portion corresponding to any of the third, sixth, . . . , 3 mth, . . . gate lines.

The 3:1 interlace processor 2 performs 3:1 interlace processing for each input image signal S0 corresponding to one field, obtaining a signal S1 whose driving frequency is decreased to ⅓. In this case, as in FIG. 7, a signal portion corresponding to P1 is extracted from the input image signal S0 corresponding to the first field; a signal corresponding to P2 is extracted from the input image signal S0 corresponding to the next field; and a signal portion corresponding to P3 is extracted from the input image signal S0 corresponding to the second next field. This processing is repeatedly executed.

The signal S1 is written in corresponding pixels of the liquid crystal panel 14 at a normal line frequency in a line sequential manner by using the switching circuit 6 which is controlled by a switching signal C and the signal line driver 10 and the gate line driver 12, each constituted by using a known technique.

Consequently, a nonused period F' during which no images are displayed is produced after an image signal of one field is written in pixels and before an image signal of the next field is written. Desired processing can be performed by using this period.

For example, in performing correction processing similar to that in the first embodiment by using this nonused period F', a signal S4, FIG. 7, is applied to the signal line driver 10.

In this embodiment, an input image signal is interlaced at a ratio of 3:1. It is also possible to use a regular noninterlace signal, an N:1 interlace signal, or an N:M (M<N) interlace signal without departing from the gist of the present invention.

(3rd Embodiment)

A liquid crystal display device according to the third embodiment of the present invention will be described below.

Figure 9A:
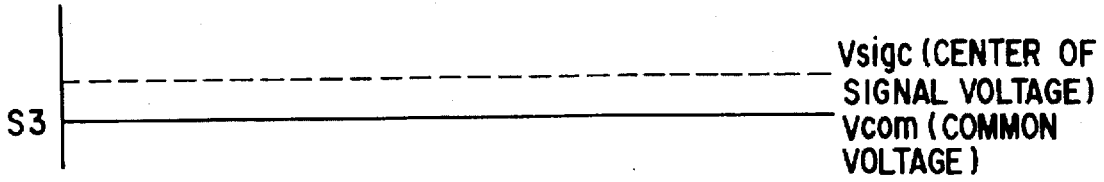
FIGS. 9A and 9B are views showing the third embodiment of the present invention.
Figure 9B:
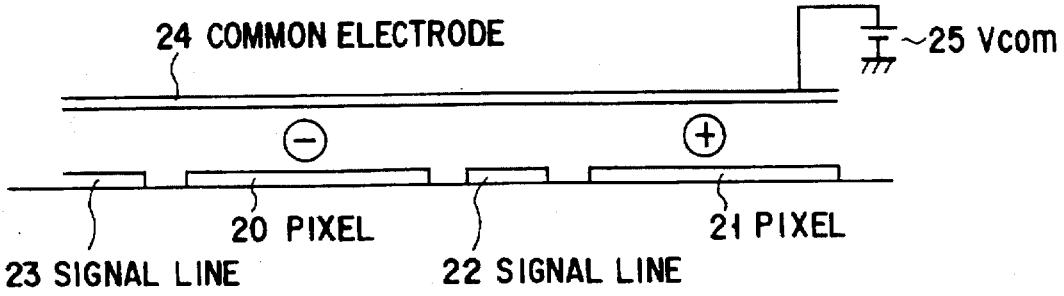

FIGS. 9A and 9B show the third embodiment. In this embodiment, as the voltage of a correction signal S3 used when the correction processing is performed as desired processing in the first and second embodiments discussed above, a voltage equivalent to a common voltage $V_{com}$ applied to a common electrode 24 is applied on signal lines 22 and 23.

Consequently, disclination caused by a transverse electric field between a pixel 20 and the signal lines 22 and 23 is reduced. This makes it possible to decrease a portion in which the disclination is currently covered with a black matrix, resulting in an improvement in the aperture efficiency.

In the above first to third embodiments, when the correction processing is performed by using, as the processor 8, a correction signal generator having a function of generating a correction signal, an increase in flicker can be decreased in situations where the holding time of a pixel switch such as a TFT or a TFD is prolonged. In addition, by providing a period in which the holding characteristics of the positive and negative polarities are corrected to be equal to each other and by making this correction period equal to or longer than the image input period, carriers generated by the pixel signal difference between the positive and negative polarities can be prevented. Consequently, it is possible to reduce an aliasing distortion. Also, a change in the amount of crosstalk resulting from the difference between images can be largely reduced by shortening the image input period or by providing a correction period equal to or longer than the image input period. This makes it possible to realize a liquid crystal display device with a high image quality.

Note that in the first to third embodiments discussed above, the voltage of the correction signal S3 is held at a fixed level in performing the correction processing as desired processing. However, it is also possible to change the correction voltage in accordance with an image or to change the correction voltage to have an input signal dependence. In addition, in conventional methods the correction period (e.g., the vertical blanking period) is very short compared to a period during which image signals are driven. However, it is desirable to set the correction period to be equal to or longer than the image driving time in order to enhance the correcting effect.

(4th Embodiment)

A liquid crystal display device according to the fourth embodiment of the present invention will be described below.

In the liquid crystal display device of this embodiment, pen input processing is performed as the desired processing performed in the nonused period F or F', explained in the first or second embodiment, during which no image display is done.

Figure 10:
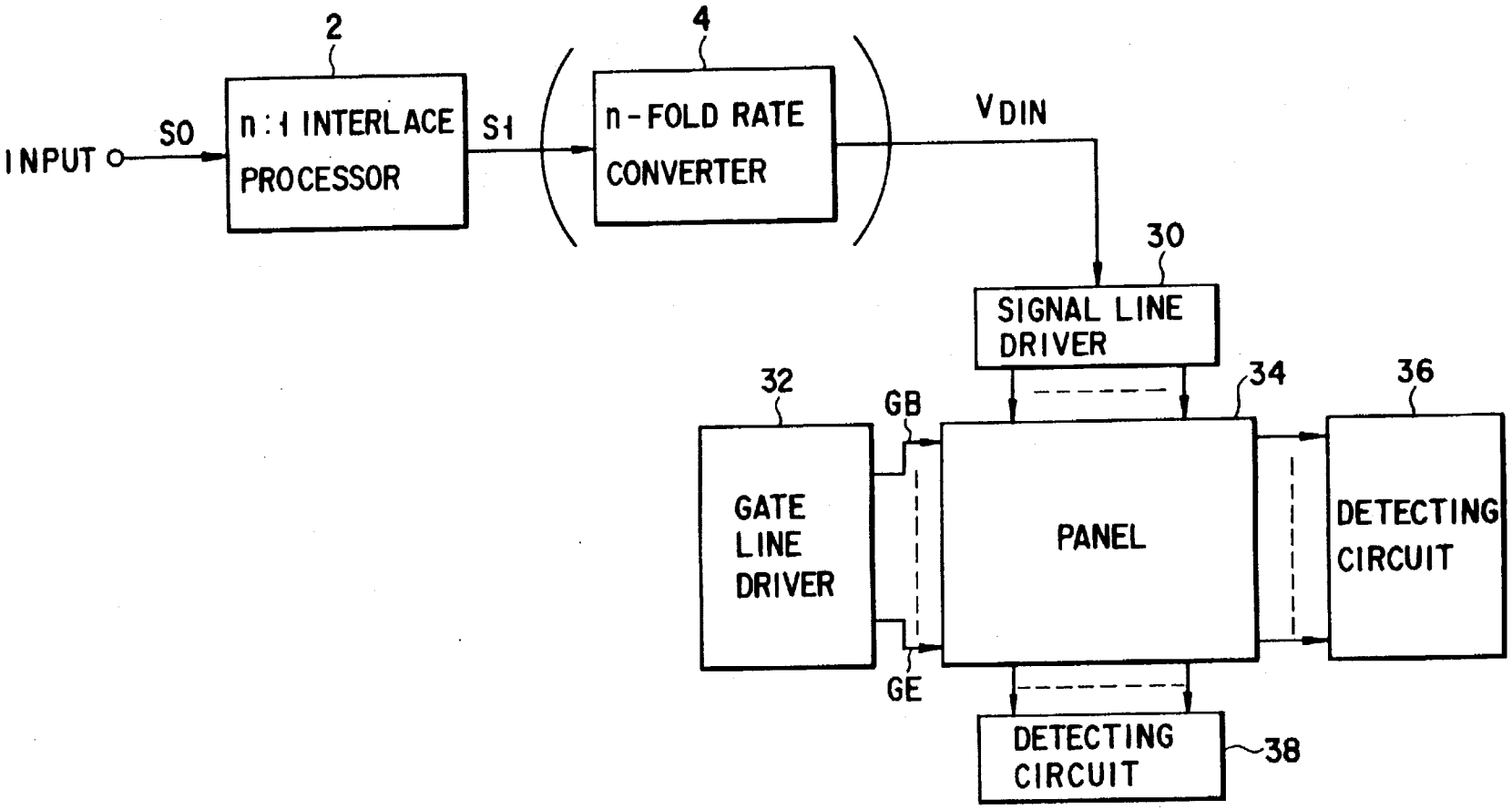
FIG. 10 is a block diagram schematically showing the arrangement of the fourth embodiment of the present invention.

FIG. 10 shows the arrangement of the major components of the liquid crystal display device of this embodiment. When the period F of the first embodiment is to be used, this liquid crystal display device is constituted by an n:1 interlace processor 2, an n-fold rate converter 4, a signal line driver 30, a gate line driver 32, a liquid crystal display panel 34, a first capacitance change detecting circuit (to be referred to as a first detecting circuit hereinafter) 36, and a second capacitance change detecting circuit (to be referred to as a second detecting circuit) 38. On the other hand, when the period F' of the second embodiment is to be used, the liquid crystal display device is constituted by the n:1 interlace processor 2, the signal line driver 30, the gate line driver 32, the liquid crystal display panel 34, the first detecting circuit 36, and the second detecting circuit 38.

Unlike in the first and second embodiments, the switching circuit 6 is not used in the configuration shown in FIG. 10. This is so because a means corresponding to the function of the switching circuit is provided in the signal line driver 30.

In addition, this embodiment uses a method which detects a position designated by a pen on the liquid crystal display panel 34 as a change in a physical quantity pertaining to the liquid crystal display panel 34. Therefore, the detecting circuits 36 and 38 are used in place of the processor 8 of the first and second embodiments. Note that it is also possible to apply a signal to the liquid crystal panel 34 during the period F or F' by using the processor 8 and the switching circuit 6 and detect this signal with a pen.

Figure 11:
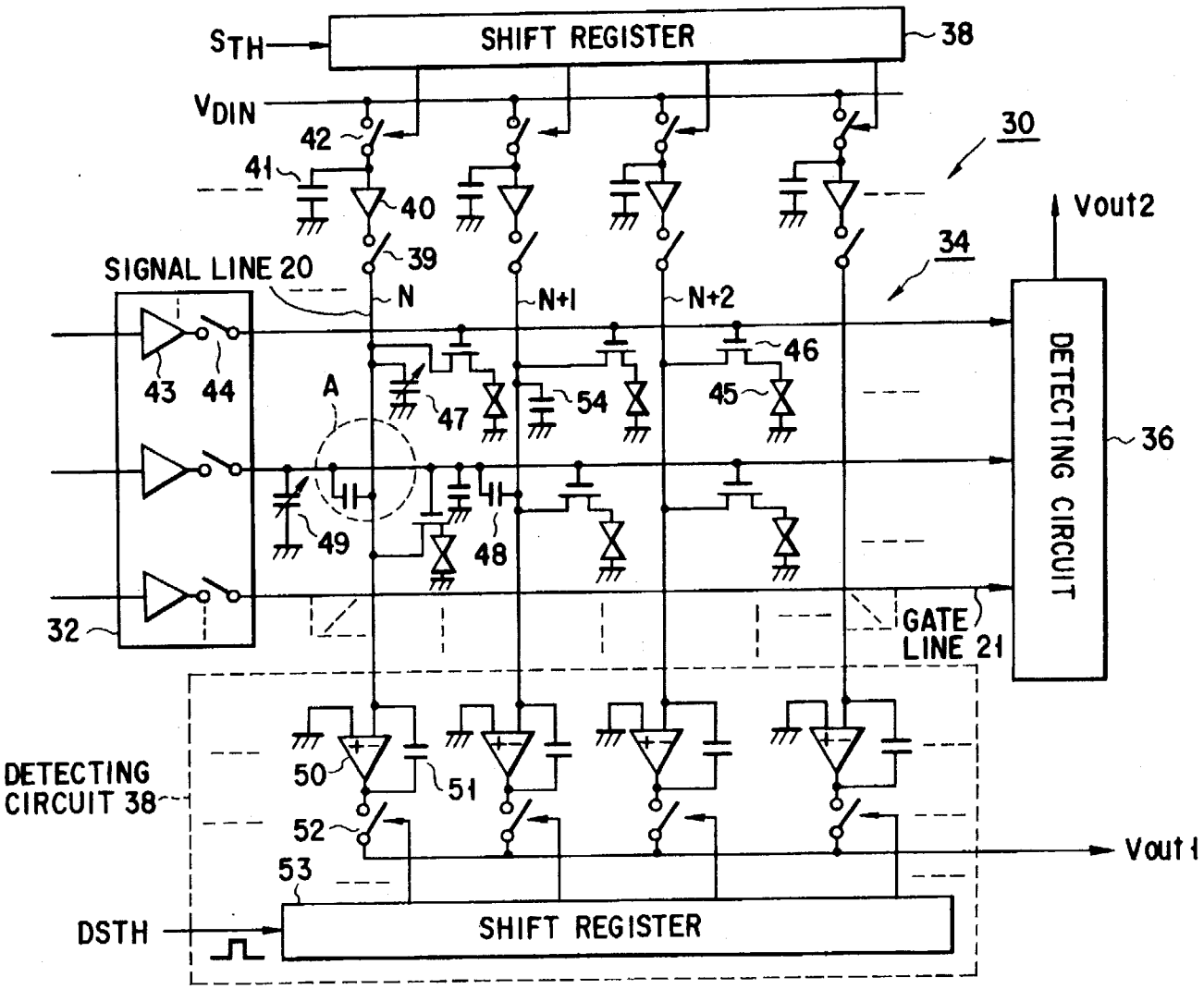
FIG. 11 is a circuit diagram showing details of the main components of the fourth embodiment of the present invention.

FIG. 11 shows details of the arrangement of the signal line driver 30, the gate line driver 32, the liquid crystal display panel 34, the first detecting circuit 36, and the second detecting circuit 38. The signal line driver 30 consists of a shift register 38, sampling-and-switching elements 42, buffers 40, capacitors 41, and switches 39. The gate line driver 32 consists of buffers 43 and switches 44. Each of the first and second detecting circuits 36 and 38 having the same arrangement is constituted by differential amplifiers 50, capacitors 51, switching elements 52, and a shift register 53.

In the above arrangement, as has been discussed earlier in the first or second embodiment, a nonused period F or F' in which no image display is performed is provided by the n:1 interlace processor 2, the n-fold rate converter 4, and the switching circuit 6, or by the n:1 interlace processor 2 and the switching circuit 6. This operation is evident from the explanation in the first and second embodiments, and so a detailed description thereof will be omitted.

Subsequently, pen input processing is performed by using this period F or F'. This pen input processing will be described below. The principle of the pen input is as follows. That is, since the capacitance of a liquid crystal changes in accordance with the cell gap, the capacitance (47, 49) changes only in a portion (a region A indicated by the dotted line in FIG. 11) pushed by a pen. Therefore, the position of the pen is detected by detecting this capacitance change. More specifically, assuming the dielectric constant, the capacitance, the cell gap, and the area of a liquid crystal are respectively $\epsilon$, C, d, and S, $C=\epsilon S/d$ Referring to FIG. 11, signal lines 20 and gate lines 21 are arranged to be perpendicular to each other in the liquid crystal display. Therefore, the detecting circuits 36 and 38 for detecting a voltage change caused by a capacitance change are provided for each signal line and each gate line to locate the position A of pen input from the intersection of the signal and gate lines. Note that the capacitance changes not at the point A alone which is depressed but within a certain wide region centering around the point A. Therefore, a method which detects a maximum value is preferred.

In a period in which images are displayed, the S/H switches 42 of the signal line driver 30 are repeatedly turned on and off by an output from the shift register 38 which is driven by a pulse STH. Consequently, a potential corresponding to the designated sample position of an image signal $V_{DIN}$ is held in each capacitor 41. The outputs from these capacitors are written, either simultaneously or sequentially, by the switches 39, in the corresponding pixels on the gate lines 21 selected by the switches 44 of the gate line driver 32. This output write operation is performed for all of the pixels.

The detecting circuit 38 then operates during either the period F after the write operation in all the pixels is completed or the period F' after the write operation in one pixel is completed. The charge written in the stray capacitance 47 of each signal line 20 is transferred to the detection capacitor 51 and converted into a voltage. The switches 52 are repeatedly turned on and off by an output from the shift register 53 which is driven by a pulse DSTH. Consequently, these voltages corresponding to the individual signal lines 20 are sequentially detected and output as a serial output signal $V_{out1}$.

Meanwhile, the detecting circuit 36 for the gate lines 21 operates during the period F or F'. The charge written in the stray capacitance 49 of each gate line 21 is transferred to the detection capacitor and converted into a voltage. Thereafter, like in the case of the signal lines, these voltages corresponding to the individual gate lines 21 are sequentially detected and output as a serial output signal $V_{out2}$.

An actual method of detection will be described below. Assuming that the capacitance change at the depressed point is $\Delta C$, the capacitance (e.g., the capacitance 47) of the signal line or the gate line which is depressed is Csel, and the capacitance (e.g., a capacitance 54) of the signal line or the gate line which is not depressed is Cnsel, $$Csel=Cnsel+\Delta C$$

Therefore, assuming the voltage before the depression is Vnsel, a voltage Vsel upon the depression is given by the equation below following the principle of conservation of charge.

$$Vsel=Vnsel.Cnsel/(Cnsel+\Delta C)$$

Figure 12:
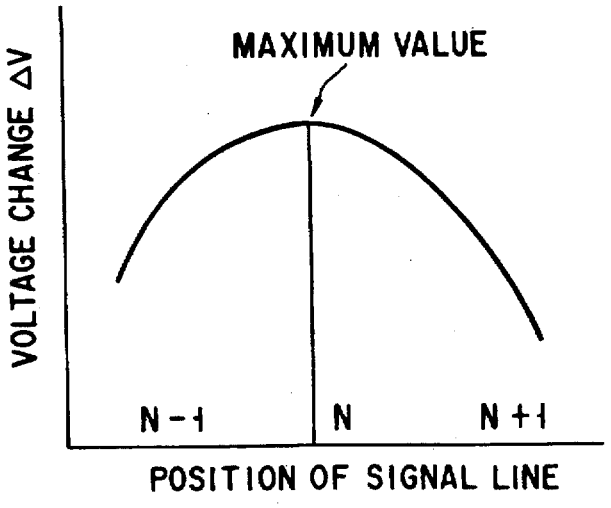
FIG. 12 is a graph for explaining the principle of position detection in the fifth embodiment of the present invention.

That is, the voltage changes. The point of depression can be located by detecting this voltage change. Of the voltages that have changed, a portion (N in FIG. 12) corresponding to the maximum voltage change is the position of the pen in the vertical direction. The position of the pen is detected as a point by similarly performing the detection in the gate line direction.

In this embodiment, the detecting circuits and the drivers are separately provided. However, a single IC can have the functions of these circuits.

When the present invention is applied to the pen input function as discussed above, the pen input processing can be performed at low speeds over long periods of time by using the period which is extended to be much longer than the blanking period used in conventional methods. This method can reduce the consumption power and is also advantageous as a countermeasure against EMI.

In addition, since a long processing time can be taken, the processing for locating a designated position can be done precisely. Consequently, it is possible to improve the detection accuracy of a designated position or to allow an operator to perform pen inputs more easily.

(5th Embodiment)

Figure 13:
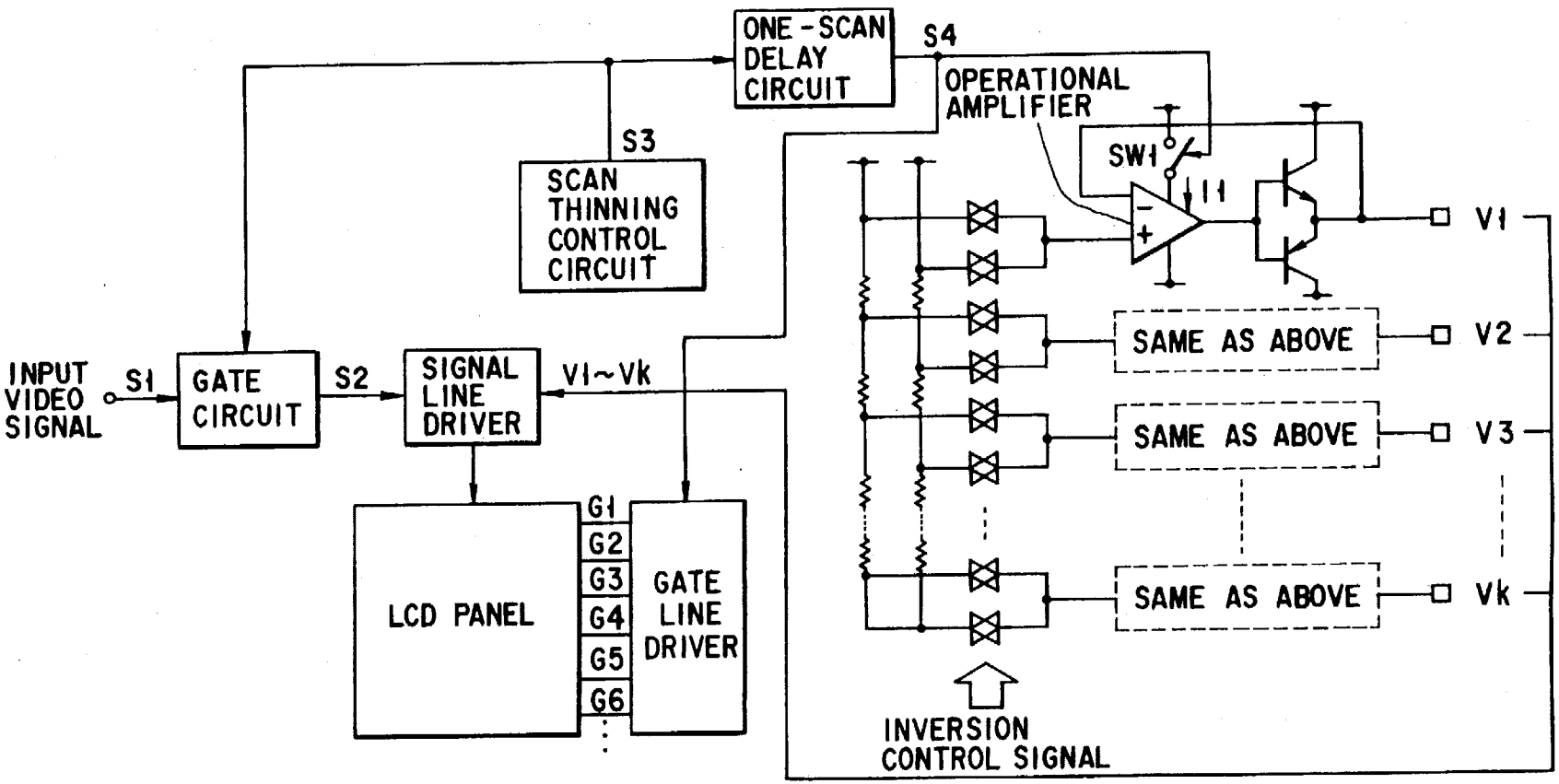
FIG. 13 is a block diagram showing the arrangement of the fifth embodiment of the present invention.
Figures 14A, 14B, 14C, 14D, 14E, 14F:
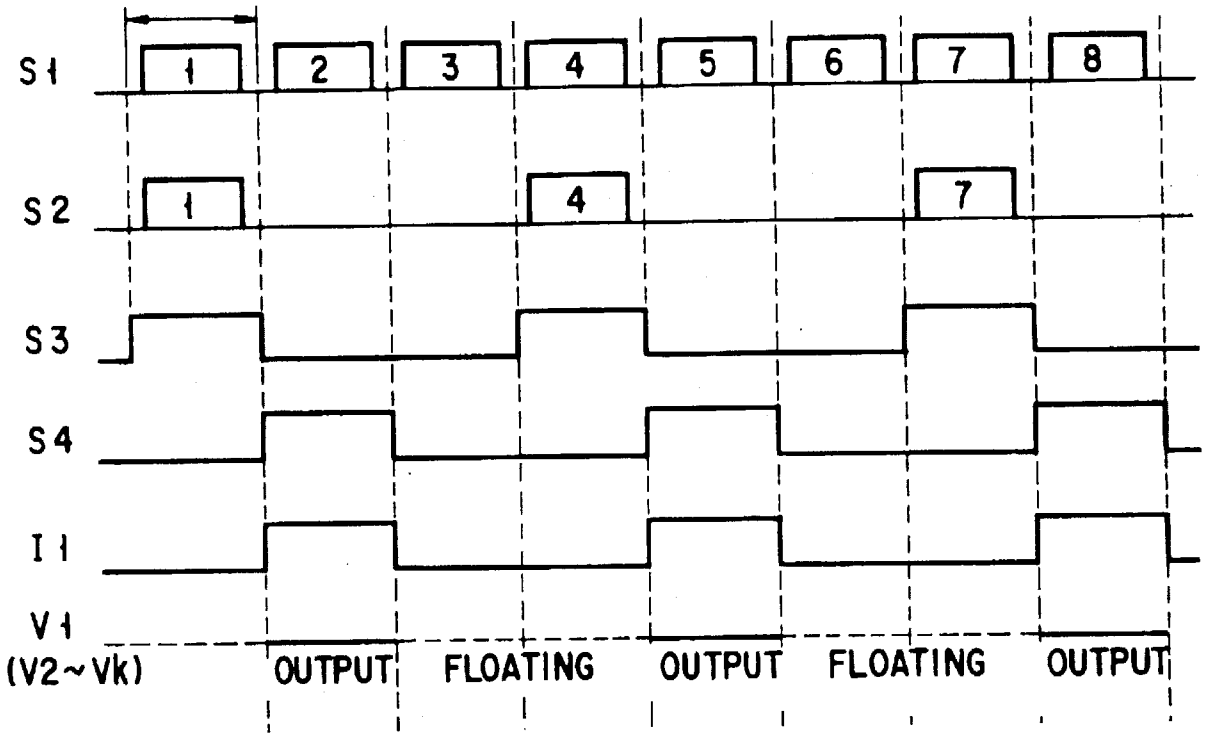
FIG. 14 is a view showing the driving signal voltages and the timing charts of the fifth embodiment of the present invention.
Figures 14G, 14H, 14I, 14J, 14K, 14L, 14M:
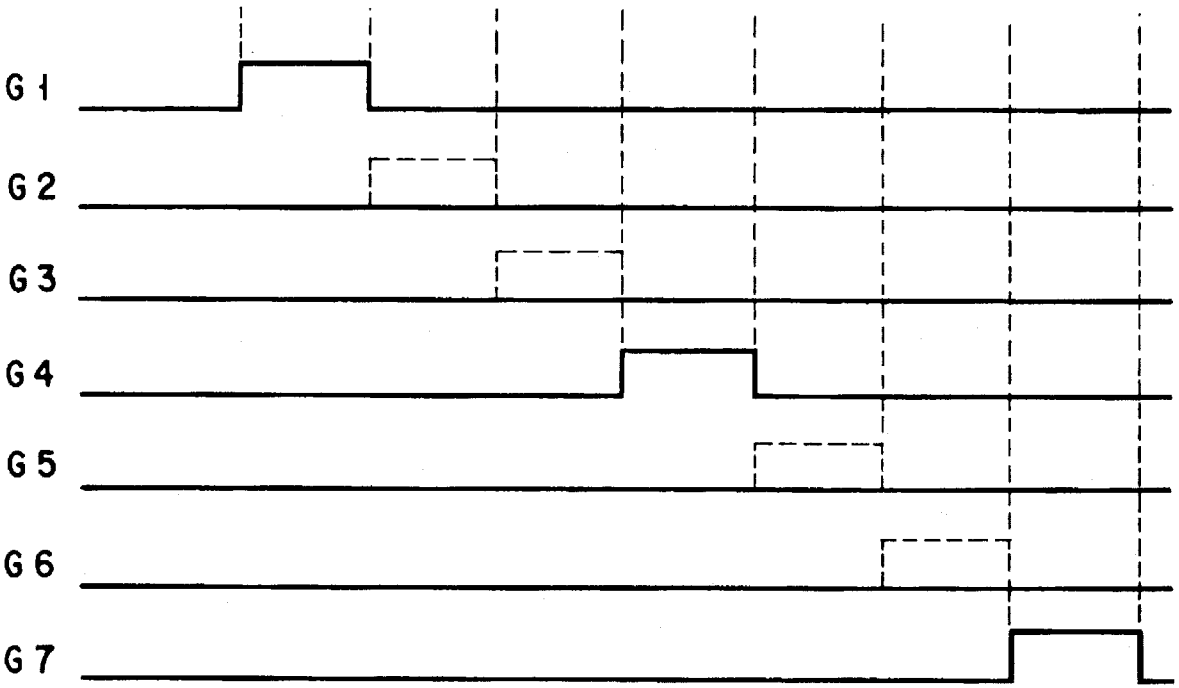

FIGS. 13 and 14 illustrate the fifth embodiment of the present invention. In this embodiment a gate circuit extracts an input signal S1 in a 3:1 interlace manner only during the high-level period of a control signal S3.

After signals 1, 4, 7, . . . , are extracted in this way, a thinned signal S2 is applied to a signal line driver and subjected to serial-to-parallel conversion. Consequently, a write operation in a pixel is performed in synchronism with a gate scan signal G1 selected by a signal S4 delayed by one horizontal period from the signal S2. After being written in a pixel, the signal can be used for any purpose until the next signal is written. This embodiment handles power that is statically consumed, such as a bias current of a gradation generator included in the signal line driver explained in "Description of the Related Art". This power is consumed even when no signal write operation is performed. To reduce this current, therefore, a circuit for cutting off supplied power is provided and controlled in synchronism with a write signal. In this embodiment operational amplifiers are elemental circuits of the gradation generator, which output V1, V2, . . . , Vk. A switch SW1 is provided between the power supply terminal of each operational amplifier and the power supply to control a static current I1 of the operational amplifier. By controlling ON/OFF of these switches SW1 by using the control signal S4, the operational amplifiers forming the gradation voltages V1 to Vk are operated only while signal lines are driven (the high-level period of S4). With this operation, as indicated by the waveform of the static current I1, the static current (bias current) flows only while it is necessary and stops flowing when it is no longer required, thereby stopping the operation of the operational amplifiers. As a result, the static current can be reduced to 1/(2N+1) as given by $$I_{MF}=I_{st}/(2N+1)$$

as well as the dynamic current. In this equation, $I_{MF}$ is the static current of MF driving, and (2N+1) is the interlace ratio.

In this embodiment, the switches for cutting off the current are provided only on the power supply side. However, these switches can also be provided on the ground side or on both the power supply and ground sides. In addition, although the interlace ratio is 3:1 in this embodiment, it is also possible to use an N:1 interlace signal or an odd-numbered interlace signal such as a 2N+1:1 signal.

Figure 15:
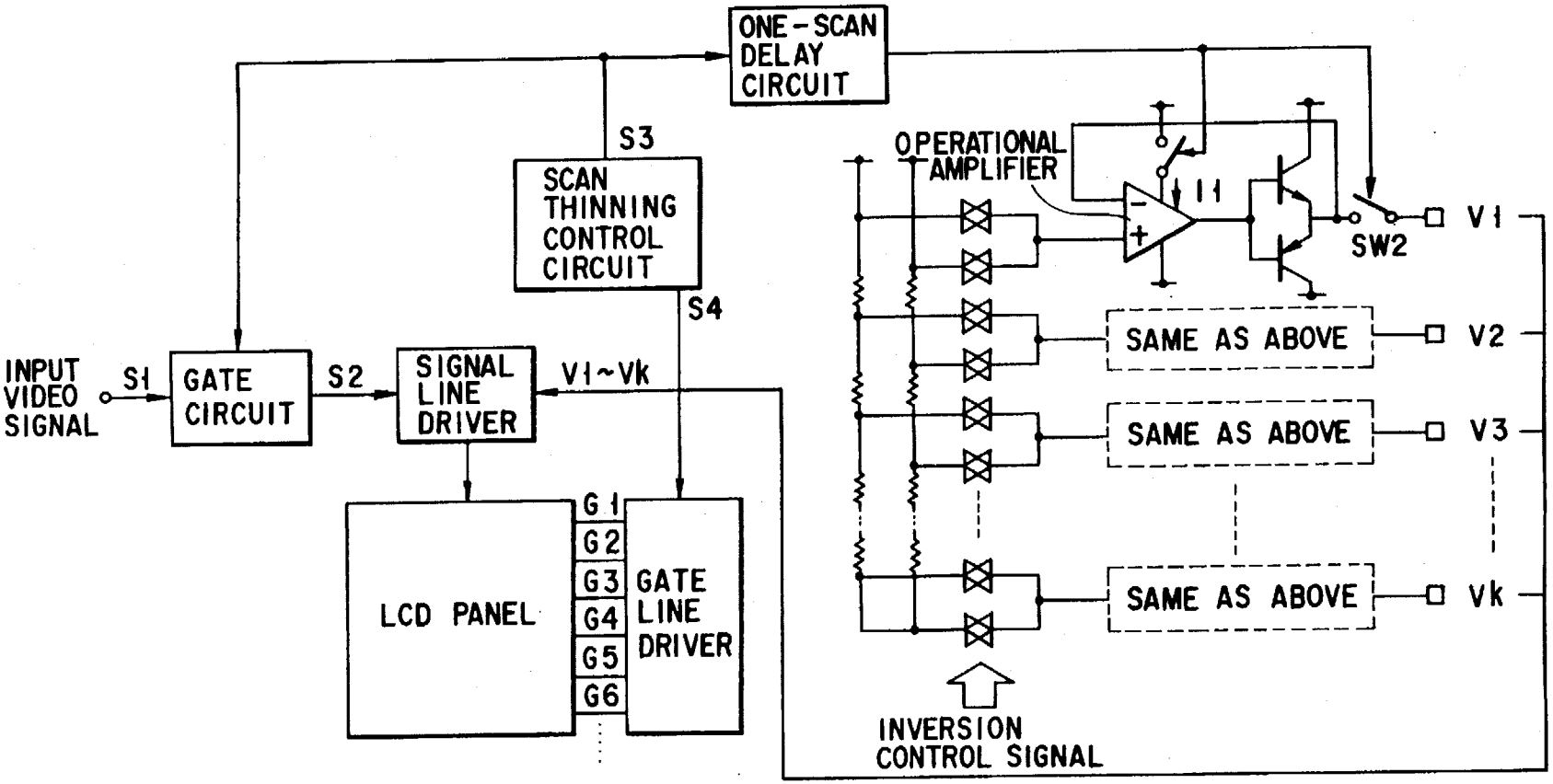
FIG. 15 is a block diagram showing the arrangement of a modification of the fifth embodiment of the present invention.

There is also the problem that if the power supply is simply cut off, the output signal changes during the period in which no pixels are driven, and the consumption power increases correspondingly. The configuration illustrated in FIG. 15 solves this problem by providing a switch SW2 at each output.

(6th Embodiment)

Figure 16A:
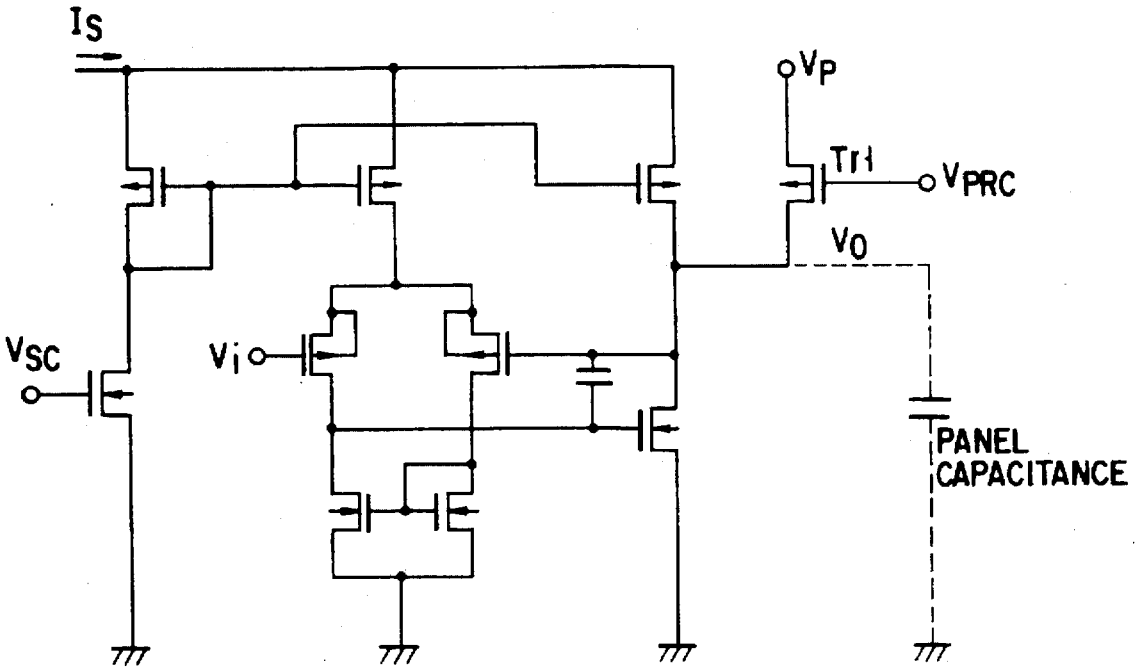
FIG. 16A is a circuit diagram showing the circuit configuration of the sixth embodiment of the present invention.
Figures 16B, 16C, 16D, 16E, 16F:
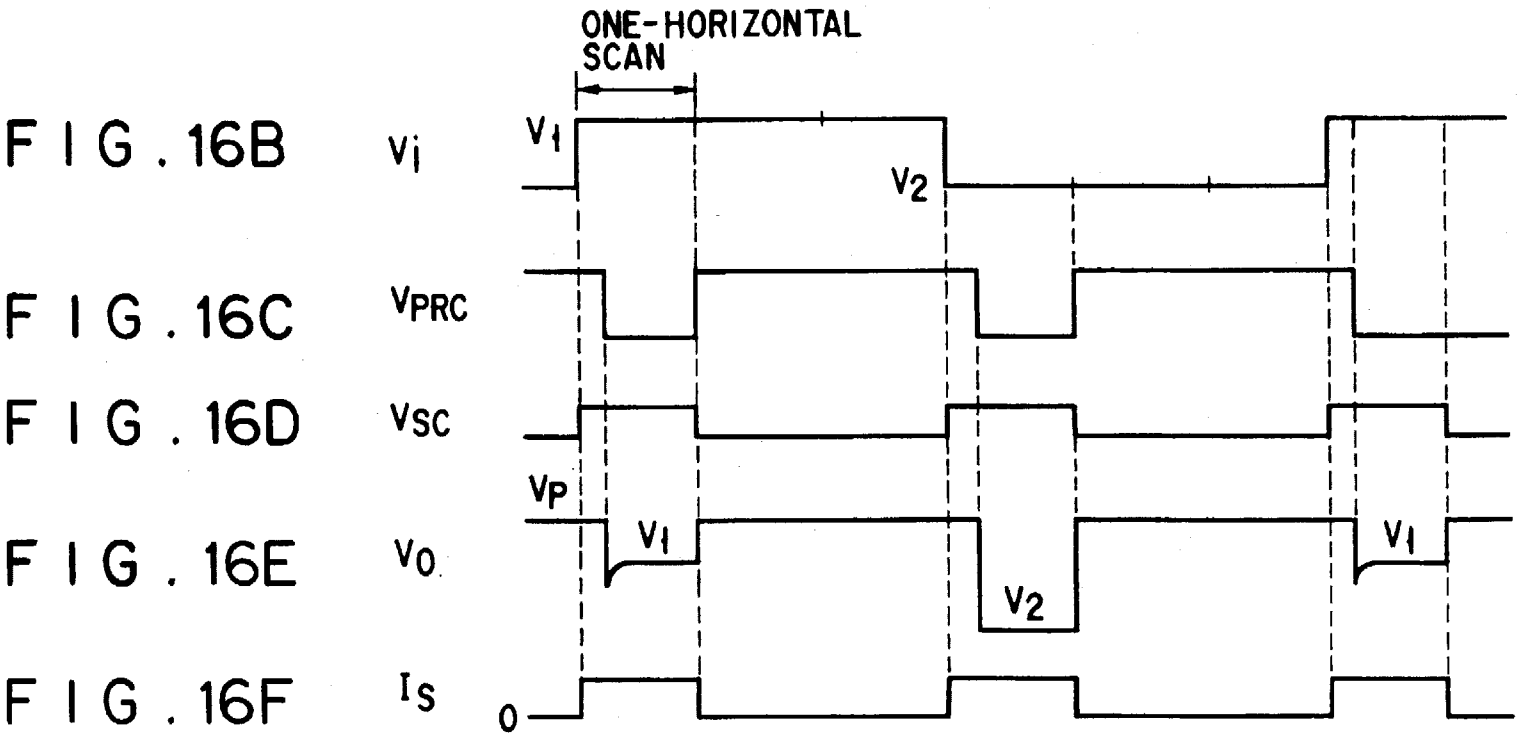
FIG. 16B is a view showing the driving signals of the sixth embodiment of the present invention.

The sixth embodiment of the present invention is shown in FIGS. 16A and 16B. In this embodiment, a bias current of an output buffer used in a signal line driver which incorporates a D/A converter is turned off during a period in which images are not rewritten. Although a bias current Is is normally at most 20 to 30 μA, a total of 40 to 60 mA in VGA level, about 2,000 times as large, is necessary as the bias current since the bias current is required for all signal lines. Consequently, the consumption power is 200 to 300 mW even at 5V. As in the first embodiment, an operation in which a 3:1 interlace signal Vi is input will be described below. To reduce this bias current, the common approach is to provide a transistor Trl for precharging the panel capacitance, thereby charging the capacitance up to a voltage Vp before driving. Thereafter, Vi is written and held for three horizontal scan periods (three H periods). However, since normally the period for charging Vi in the capacitance need only be one H period, the power is wasted in the last two H periods. In this embodiment, therefore, Vsc which determines the bias current is lowered during these two H periods to cut the bias current. In addition, the transistor Trl for precharge is turned on to simultaneously stabilize the output voltage and perform precharge for a signal to be written next. Almost no additional circuit is required to perform this operation, so nearly no increase results in the cost and the chip area. Also, in this embodiment the static consumption power can be reduced to 1/(2N+1), as in the above fifth embodiment. Furthermore, in conventional systems the power OFF period (e.g., the vertical blanking period) is very short in comparison with a period in which image signals are driven. In the present invention, however, to enhance the power consumption reducing effect, this period can be increased to be equal to or longer than the image driving time.

(7th Embodiment)

Figure 17:
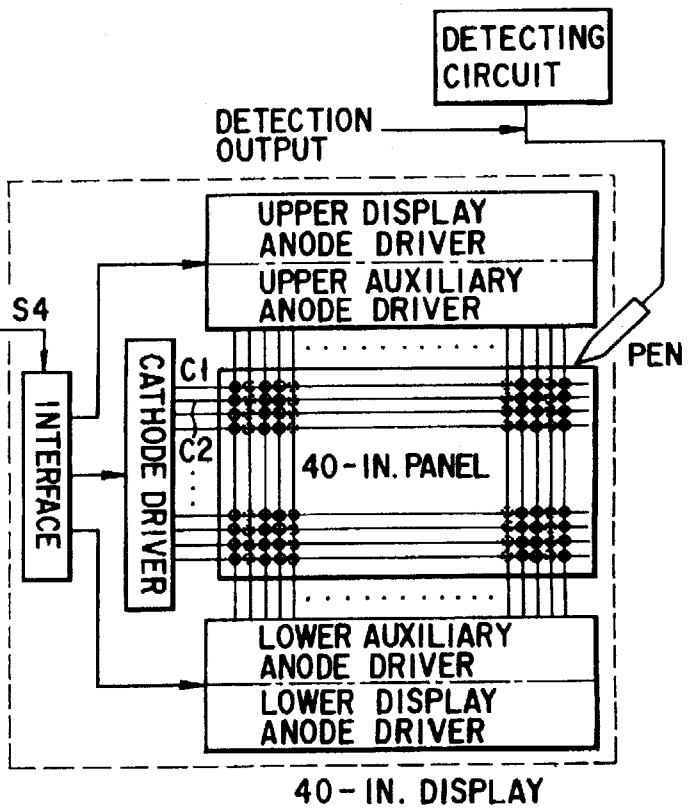
FIG. 17 is a perspective view showing the structure of a DC type PDP of the seventh embodiment of the present invention.
Figure 18:
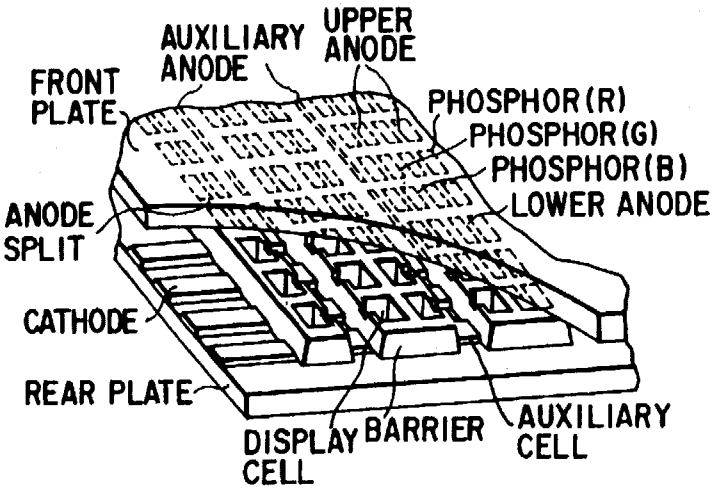
FIG. 18 is a block diagram showing the circuit configuration of the seventh embodiment of the present invention.
Figures 19A, 19B, 19C, 19D, 19E, 19F, 19G, 19H, 19I:
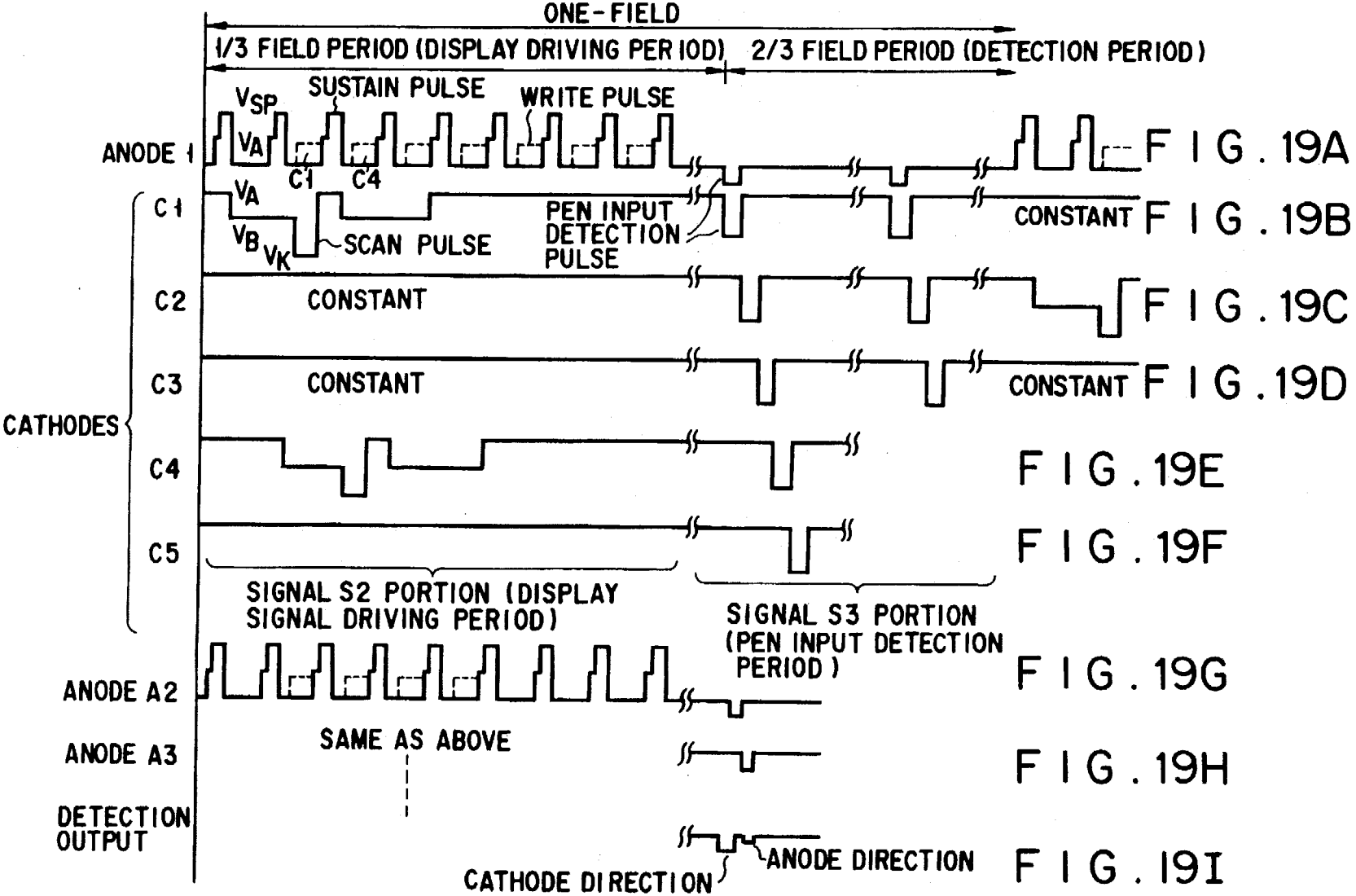
FIG. 19 is a view showing the driving signal voltages and the timing charts of the seventh embodiment of the present invention.

FIGS. 17, 18, and 19 show the seventh embodiment of the present invention in which the present invention is applied to a plasma display (PDP). FIG. 17 shows the structure of a DC type PDP. In FIG. 17, anode and cathode electrodes are respectively arranged parallel to each other on upper and lower glass substrates, and a plasma gas is sealed between the substrates. The principle of luminescence is that discharge occurs when a voltage is applied between the anode and the cathode, and this discharge strikes a phosphor to emit light. In FIG. 18, a display signal is interlaced at a ratio of 3:1 and read out at a triple rate, thereby compressing the period during which the display signal drives a panel to ⅓. During a period in which no display driving is performed, respective specific signals are applied to the cathode and anode electrodes, permitting detection of a pen input position.

The display signal is basically an 8-bit signal. This 8-bit signal is separated into individual bits by an interface circuit and applied as the display signal in a bit serial manner to the panel. During the period in which the display signal is driven, a scan pulse is applied to the cathode electrodes. In synchronism with this scan pulse, the anode electrodes apply the display signal and a sustain pulse for sustaining luminescence. (That is, a memory property is attained.) As a result, the display signal is written in each pixel, and this state is held during a period in which the sustain pulse is applied. This sustain pulse application period differs from one bit to another. Upon being subjected to pulse-width modulation, the period is visually sensed as its average luminance. On the other hand, during the period in which no display signal is driven no voltage need be applied to the cathode electrodes. This period is used to detect pen inputs. That is, the cathode electrodes are applied with any of a voltage, a phase, and a waveform (a serial address signal: e.g., 9-bit data if the number of scanning lines is 480) inherent in each electrode, or a combined signal of these factors. For example, in this embodiment a voltage with an amplitude by which no luminescence takes place is applied to the individual electrodes by using pulses having different phases. This phase change is detected through a stray capacitance between the anode electrode and a pen by a detector incorporated into the pen. Since these electrodes have pulses of different phases, it is readily possible to detect the cathode electrode of interest by detecting its phase. Detection in the address direction is done as follows. That is, during the period in which no display signal comes the anode electrode applies any of a voltage, a phase, and a waveform inherent in its address, or a combined signal of these factors. This signal, of course, has a level at which no luminescence occurs (i.e., the display is not influenced). This pulse is also similarly detected by a detecting circuit incorporated into the pen. Consequently, the pen input position can be located with a high accuracy. To distinguish between the address direction and the cathode direction, some features, such as amplitude pulse widths, must be added to the signals applied to the anodes and the cathodes. In this embodiment, the pen detection signal can be applied in a period equal to or longer than the period during which the display signal is driven. Consequently, the frequency of the detection signal is lowered, and this facilitates detection of the phase or the frequency change. In addition, since the display and pen inputs can be performed in a serial manner, the control processing and the detection signal processing can be performed by the same CPU without adding no special circuits. Furthermore, if the frequency of the detection signal is increased, more than one pen inputs can be detected during one field period, since the detection period is longer than that in methods in which detection is done in the blanking period. This increases the pen input detection rate. The detection rate is normally said to be 100 times/sec, and the detection must be done at a rate higher than the field frequency. The method of the present invention can effectuate this. In this method detection is impossible for one line out of every three lines. However, when a pen moves at a high speed its motion is usually smooth, so the motion can be interpolated with peripheral pixels. Even if this is not possible, the line of interest alone can be interpolated after being detected during blanking. In addition, by increasing the interlace scan ratio only during the pen input period, the number of lines to be interpolated can be decreased. This also facilitates the detection processing.

In this embodiment, the present invention is discussed by taking a DC type PDP as an example. However, the present invention is also applicable to another display device, such as an AC type PDP, insofar as the device has a memory property.

(Eighth Embodiment)

Figure 20:
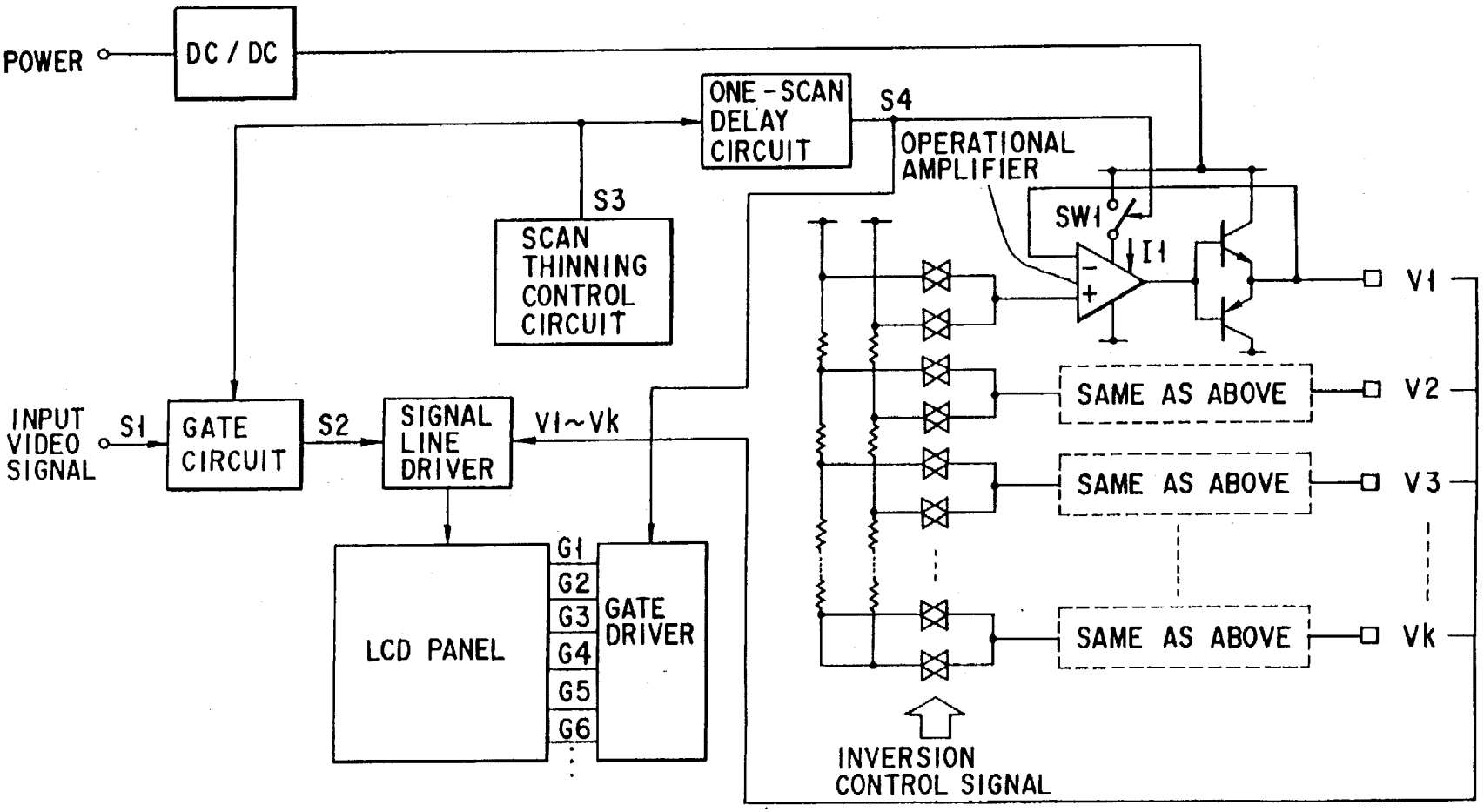
FIG. 20 is a block diagram showing the arrangement of the eighth embodiment of the present invention.

In the case where an MF drive is carried out, it is not necessary to output a gradation signal during a non-selection period. Accordingly, it is not required to transmit a power to the OP amplifier IC for gradation signal during the period, and therefore a DC/DC converter shown in FIG. 20 may not be operated. In specific, the DC/DC converter is not operated as an input to the inductance L in the DC/DC converter is controlled, or the control mode of its switch is changed to a variable mode type, during the non-selection period.

Figure 21:
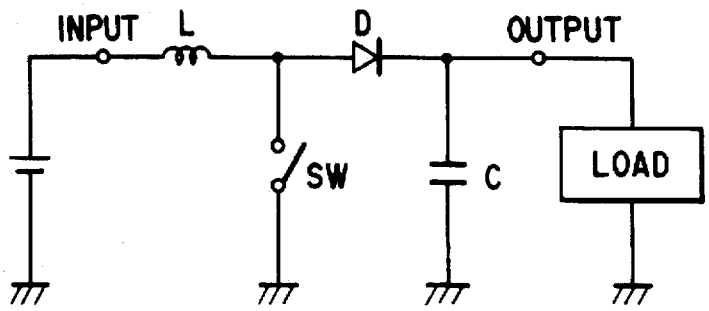
FIG. 21 is a basic circuit diagram of DC/DC converter.

FIG. 21 is a basic circuit diagram of a DC/DC converter. The actual operation of the above-described mode is carried out basically in the following two manners.

Figure 22:
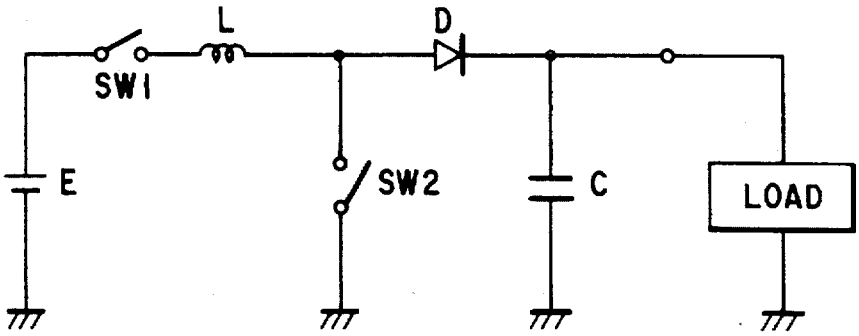
FIG. 22 is a circuit diagram for DC/DC low power method, example I.

(1) In the case where the input to the inductance L is controlled, a switch (called SW1 hereinafter) shown in FIG. 22 is operated.

(2) A switch (SW2) designed to transmit the energy stored in the inductance L to a capacitor C and a load, is operated.

In the manner (1), a signal (OESW) for controlling SW1 is formed based on a signal (OEF) for controlling an on/off operation of a scanning line. In specific, with the structure in which a signal line voltage is output during the following scanning period after signals for one line are stored in a signal line driver, OESW has a signal waveform which is shifted by one horizontal period from that of OEF.

In this case, SW1 is controlled to apply a voltage to the inductance L. For such a control, there are two possible structures, namely one in which a completely high impedance state is created, and another in which a switching operation is carried out between different voltages (to set the voltage of non-selection period lower than that of selection period).

Figure 23:
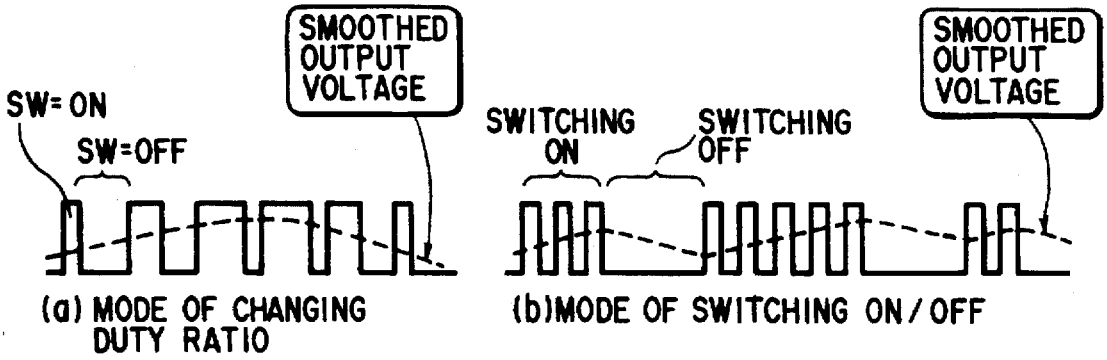
FIG. 23 is diagrams showing switching modes of control SW2.

In the manner (2), there are two possible control modes of SW2: mode (a) in which a duty ratio is changed when the switch is turned on/off, and mode (b) in which the output voltage is controlled by turning on/off the switch itself while maintaining the duty ratio at constant (see FIG. 23).

More specifically, a smoothed output voltage is set at a predetermined voltage level during the selection period, and at a voltage level for the low-consumption power state during the non-selection period. The voltage level can be adjusted appropriately since the number of the on/off operations during the selection period differs from that of the non-selection period.

The on/off time periods of the switch are appropriately set in consideration of the rise time of the DC/DC converter.

Figure 24:
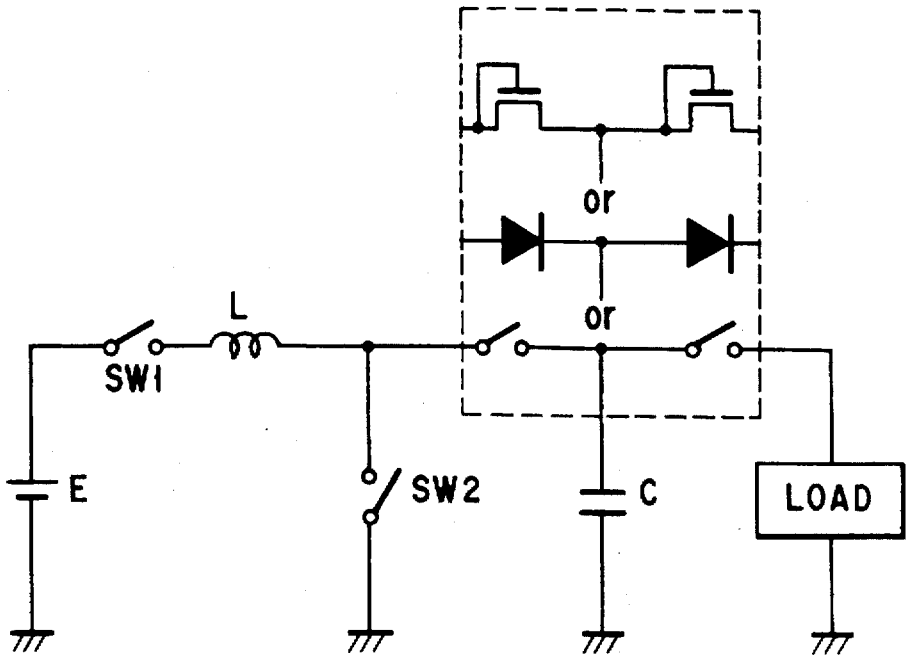
FIG. 24 is a circuit diagram for DC/DC low power method, example II.

In connection with the above-described modes, in order to stabilize the output voltage to a load, and prevent an increase in consumption power caused by a charge/discharge with part of the charge of the capacitance in the load circuit, switches or elements corresponding thereto are provided for the output side of the DC/DC converter. More specifically, as shown in FIG. 24, such control is carried out by diodes or non-linear resistances or switch elements, and a capacitance. With regard to the switch elements, SW3 and SW4 are turned on/off at the same time, or during the non-selection period, SW4 is turned off first, then SW3 is turned off, or during the selection period, SW3 is turned on first, and SW4 is turned on.

Figure 25:
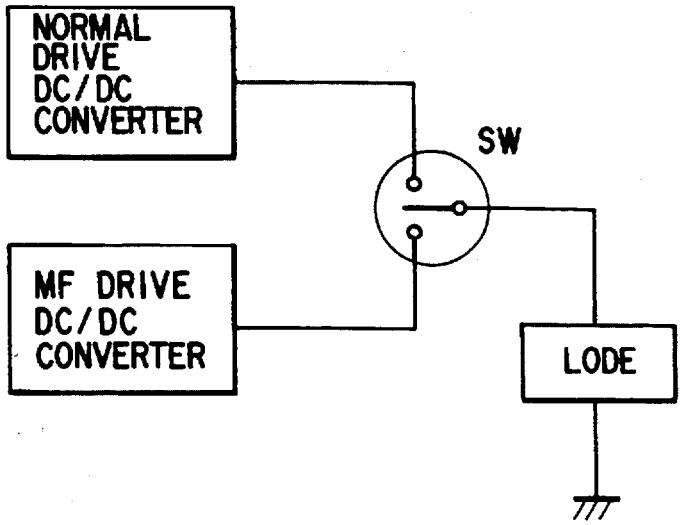
FIG. 25 is a circuit diagram for DC/DC converter switching method.

Alternatively, two DC/DC converters different in driving mode may be provided. In this case, a DC/DC converter for normal drive (driven at 60 Hz) and another DC/DC converter for MF drive are prepared, and one of the converters is selected in accordance with the selected driving mode (see FIG. 25). With this structure, the most appropriate DC/DC converter designed to have an efficiency for low-power consumption drive can be selected, and therefore the low-consumption power can be effectively achieved.

In addition, with this embodiment, the consumption power at the oscillation circuit, which is consumed as the offset amount of the DC/DC converter, can be reduced.

In addition, the present invention is not limited to the above embodiments but can be practiced in the form of various modifications without departing from the spirit and scope of the invention.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A display device having a pixel selection switching, element, comprising:

interlace processing means for performing n (n is an integer of not less than 2): m (m is an arbitrary number of not more than n) interlace processing for a one-frame image signal to form an interlaced image signal;

image display means for displaying an image by driving said pixel selection switching element in accordance with the interlaced image signal;

non-picture period processing means for disconnecting said interlace processing means from said image display means and performing processing other than display for said image display means during a non-picture period after an image signal corresponding to a plurality of pixels is displayed and before an image signal corresponding to a next pixel is displayed; and wherein the processing performed for said image display means in the non-picture period is processing in which a correction signal is applied to each pixel to improve image quality.

2. A display device having a pixel selection switching element, comprising:

interlace processing means for performing n (n is an integer of not less than 2): m (m is an arbitrary number of not more than n) interlace processing for a one-frame image signal to form an interlaced image signal;

image display means for displaying an image by driving said pixel selection switching element in accordance with the interlaced image signal:

non-picture period processing means for disconnecting said interlace processing means from said image display means and performing processing other than display for said image display means during a non-picture period after an image signal corresponding to a plurality of pixels is displayed and before an image signal corresponding to a next pixel is displayed; and wherein the processing performed for said image display means in the non-picture period is pen input processing for detecting a position on a liquid crystal panel designated by an operator with an input pen.

3. A display device having a pixel selection switching element, comprising:

interlace processing means for performing n (n is an integer of not less than 2): m (m is an arbitrary number of not more than n) interlace processing for a one-frame image signal to form an interlaced image signal;

image display means for displaying an image by driving said pixel selection switching element in accordance with the interlaced image signal;

non-picture period processing means for disconnecting said interlace processing means from said image display means and performing processing other than display for said image display means during a non-picture period after an image signal corresponding to a plurality of pixels is displayed and before an image signal corresponding to a next pixel is displayed; and wherein the processing performed for said image display means in the non-picture period is performed by power control means for disconnecting a power supply for supplying power to said image display means from some or all of circuits in said image display means while said pixel selection switching element is kept OFF.

4. A device according to claim 3, wherein an output from said image display means is set to have a high impedance during a period in which said power control circuit disconnects said power source from said image display means.

5. A device according to claim 3, wherein said circuit in said image display means, which is disconnected from said power supply is a gradation generating circuit included in a signal line driving circuit.

6. A device according to claim 3, wherein said circuit in said image display means, which is disconnected from said power source is a bias current circuit of a signal line driver.

7. A display device having pixel selection switching elements in a one-to-one correspondence with pixels, comprising:

interlace processing means for performing n (n is an odd number of not less than 3): m (m is an arbitrary number of not more than n) interlace processing for a one-frame image signal to form an interlaced image signal;

image display means for displaying an image by driving said pixel selection switching elements in accordance with the interlaced image signal;

non-picture period processing means for disconnecting said interlace processing means from said image display means and performing processing other than display for said image display means during a non-picture period after an image signal corresponding to one scanning line is displayed and before an image signal corresponding to a next scanning line is displayed; and wherein the processing performed in the non-picture period is processing in which a correction signal is applied to each pixel to improve image quality.

8. A display device having pixel selection switching elements in a one-to-one correspondence with pixels, comprising:

interlace processing means for performing n (n is an odd number of not less than 3): m (m is an arbitrary number of not more than n) interlace processing for a one-frame image signal to form an interlaced image signal;

image display means for displaying an image by driving said pixel selection switching elements in accordance with the interlaced image signal;

non-picture period processing means for disconnecting said interlace processing means from said image display means and performing processing other than display for said image display means during a non-picture period after an image signal corresponding to one scanning line is displayed and before an image signal corresponding to a next scanning line is displayed; and wherein the processing performed in the non-picture period is pen input processing for detecting a position on a liquid crystal panel designated by an operator with an input pen.

9. A display device having pixel selection switching elements in a one-to-one correspondence with pixels, comprising:

interlace processing means for performing n (n is an odd number of not less than 3): m (m is an arbitrary number of not more than n) interlace processing for a one-frame image signal to form an interlaced image signal;

image display means for displaying an image by driving said pixel selection switching elements in accordance with the interlaced image signal;

non-picture period processing means for disconnecting said interlace processing means from said image display means and performing processing other than display for said image display means during a non-picture period after an image signal corresponding to one scanning line is displayed and before an image signal corresponding to a next scanning line is displayed; and wherein said display device is a liquid crystal display device in which liquid crystal elements providing pixels are arranged in a matrix manner, said liquid crystal display device comprising:

a plurality of signal lines for supplying an image signal to said elements providing pixels via said pixel selection switching elements;

a plurality of gate lines for controlling conduction of said switching elements; and a common electrode opposing said elements providing pixels and applied with a common voltage.

10. A device according to claim 9, wherein the processing performed in the non-picture period is processing for applying a negative signal to a pixel portion in order to make holding characteristics of positive and negative polarities equal to each other.

11. A device according to claim 9, wherein the processing performed in the non-picture period is processing in which a voltage equivalent to the common voltage applied to said common electrode is applied to the signal lines.

12. A device according to claim 9, wherein the processing performed in the non-picture period is processing for detecting a change in a capacitance of a liquid crystal caused when an operator performs a pen input.

13. A display device having pixel selection switching elements in a one-to-one correspondence with pixels, comprising:

interlace processing means for performing n (n is an odd number of not less than 3): m (m is an arbitrary number of not more than n) interlace processing for a one-frame image signal to form an interlaced image signal;

image display means for displaying an image by driving said pixel selection switching element in accordance with the interlaced image signal;

non-picture period processing means for disconnecting said interlace processing means from said image display means and performing processing other than display for said image display means during a non-picture period after an image signal corresponding to one scanning line is displayed and before an image signal corresponding to a next scanning line is played; and wherein said display means uses a multifield driving method in which a driving frequency is lowered by dividing one field image into an odd number of subfield images.

* * * * *